US011648179B2

(12) United States Patent
McDowell et al.

(10) Patent No.: US 11,648,179 B2
(45) Date of Patent: May 16, 2023

(54) SEALER-LESS PLASMA BOTTLE AND TOP FOR SAME

(71) Applicant: Haemonetics Corporation, Boston, MA (US)

(72) Inventors: Christopher S. McDowell, Murray, UT (US); Matthew J. Murphy, Marshfield, MA (US)

(73) Assignee: Haemonetics Corporation, Boston, MA (US)

( * ) Notice: Subject to any disclaimer, the term of this patent is extended or adjusted under 35 U.S.C. 154(b) by 1248 days.

(21) Appl. No.: 16/161,482

(22) Filed: Oct. 16, 2018

(65) Prior Publication Data

US 2019/0046406 A1 Feb. 14, 2019

Related U.S. Application Data

(63) Continuation-in-part of application No. PCT/US2017/032824, filed on May 16, 2017.
(Continued)

(51) Int. Cl.
*A61J 1/14* (2006.01)
*A61J 1/05* (2006.01)
(Continued)

(52) U.S. Cl.
CPC ..... *A61J 1/2079* (2015.05); *A61J 1/03* (2013.01); *A61J 1/05* (2013.01); *A61J 1/10* (2013.01);
(Continued)

(58) Field of Classification Search
CPC ..... A61J 1/03; A61J 1/05; A61J 1/10; A61J 1/14; A61J 1/1406; A61J 1/1425;
(Continued)

(56) References Cited

U.S. PATENT DOCUMENTS 2,447,691 A 8/1948 Evans
3,952,902 A 4/1976 Prouty et al.
(Continued)

FOREIGN PATENT DOCUMENTS

CN 2199152 Y 5/1995
CN 2665055 Y 12/2004
(Continued)

OTHER PUBLICATIONS

Supplementary European Search Report for Application No. 17799981.0, dated Nov. 6, 2019, 8 pages.
(Continued)

*Primary Examiner* — Benjamin J Klein
(74) *Attorney, Agent, or Firm* — McCarter & English, LLP; Jonathan C. Lovely

(57) ABSTRACT

A top for a plasma storage container includes a top body that defines the structure of the top and seals an opening of the plasma storage container. The top also includes a first opening and a vent opening extending through the top body. A valve mechanism is located at least partially within the top body and includes an aperture therethrough. The aperture opens upon connection of a blunt cannula to provide access to the interior of the plasma storage container. The top also includes a vent filter. The vent filter allows air to vent through the vent opening during plasma collection.

48 Claims, 19 Drawing Sheets

Related U.S. Application Data

(60) Provisional application No. 62/674,913, filed on May 22, 2018, provisional application No. 62/337,031, filed on May 16, 2016.

(51) Int. Cl.

| | |
|---|---|
| ***A61J 1/20*** | (2006.01) |
| ***A61J 1/03*** | (2023.01) |
| ***A61J 1/10*** | (2006.01) |
| ***B01L 3/00*** | (2006.01) |

(52) U.S. Cl.

CPC ..... *A61J 1/14* (2013.01); *A61J 1/1406* (2013.01); *A61J 1/1425* (2015.05); *A61J 1/1475* (2013.01); *A61J 1/1481* (2015.05); *B01L 3/508* (2013.01); *B01L 3/50825* (2013.01); *A61J 1/1487* (2015.05); *B01L 2200/026* (2013.01); *B01L 2200/141* (2013.01); *B01L 2300/042* (2013.01); *B01L 2300/044* (2013.01); *B01L 2300/049* (2013.01); *B01L 2300/0681* (2013.01); *B01L 2300/0832* (2013.01); *B01L 2400/0638* (2013.01); *B01L 2400/0644* (2013.01)

(58) Field of Classification Search

CPC ..... A61J 1/1475; A61J 1/1481; A61J 1/1487; B01L 3/508; B01L 3/50825; B01L 3/22; B01L 3/026; B01L 3/141; B01L 2300/042; B01L 2300/044

See application file for complete search history.

(56) References Cited

U.S. PATENT DOCUMENTS

| | | | | |
|---|---|---|---|---|
| 4,508,236 | A | 4/1985 | Keilman et al. | |
| 4,568,345 | A * | 2/1986 | Keilman | A61J 1/1425 604/403 |
| 4,744,785 | A * | 5/1988 | Rosenthal | A61M 1/0001 604/320 |
| 5,045,077 | A | 9/1991 | Blake, III | |
| 5,132,026 | A | 7/1992 | Baluyot et al. | |
| 5,658,260 | A | 8/1997 | Desecki et al. | |
| 6,012,596 | A | 1/2000 | Oglesbee et al. | |
| 6,056,731 | A | 5/2000 | Koetke et al. | |
| 6,090,091 | A | 7/2000 | Fowles et al. | |
| 6,168,037 | B1 | 1/2001 | Grimard | |
| 6,171,261 | B1 | 1/2001 | Niermann et al. | |
| 6,209,738 | B1 | 4/2001 | Jansen et al. | |
| 6,221,041 | B1 | 4/2001 | Russo | |
| 6,261,266 | B1 | 7/2001 | Jepson et al. | |
| 6,391,014 | B1 | 5/2002 | Silverman | |
| 6,426,049 | B1 | 7/2002 | Rosen et al. | |
| 6,475,194 | B2 | 11/2002 | Domici, Jr. et al. | |
| 6,616,632 | B2 | 9/2003 | Sharp et al. | |
| 6,648,859 | B2 | 11/2003 | Bitdinger et al. | |
| 6,702,779 | B2 | 3/2004 | Connelly et al. | |
| 6,715,520 | B2 | 4/2004 | Andreasson et al. | |
| 6,796,957 | B2 | 9/2004 | Carpenter et al. | |
| 6,979,316 | B1 | 12/2005 | Rubin et al. | |
| 7,033,339 | B1 | 4/2006 | Lynn | |
| 7,063,673 | B2 | 6/2006 | Marsden | |
| 7,985,216 | B2 | 7/2011 | Daily et al. | |
| 8,262,641 | B2 | 9/2012 | Vedrine et al. | |
| 8,303,914 | B2 | 11/2012 | Zurcher | |
| 8,348,904 | B2 | 1/2013 | Petersen | |
| 8,465,460 | B2 | 6/2013 | Yodat et al. | |
| 8,523,814 | B2 | 9/2013 | Finke | |
| 8,869,635 | B2 | 10/2014 | Daniel et al. | |
| 8,900,212 | B2 | 12/2014 | Kubo | |
| 8,905,994 | B1 | 12/2014 | Lev et al. | |
| 8,915,890 | B2 | 12/2014 | Lum et al. | |
| 8,932,264 | B2 | 1/2015 | DeSalvo | |
| 8,961,489 | B2 | 2/2015 | Schwarz et al. | |
| 8,986,264 | B2 | 3/2015 | Kimmel et al. | |
| 9,198,831 | B2 | 12/2015 | Rogers | |
| 9,295,788 | B2 | 3/2016 | Green | |
| 9,381,137 | B2 | 7/2016 | Garfield et al. | |
| 9,414,990 | B2 | 8/2016 | Ivosevic et al. | |
| 9,554,967 | B2 | 1/2017 | Moia et al. | |
| 9,597,260 | B2 | 3/2017 | Ivosevic et al. | |
| 9,642,774 | B2 | 5/2017 | Sattig | |
| 9,668,939 | B2 | 6/2017 | Carrel et al. | |
| 9,789,027 | B2 | 10/2017 | Sund et al. | |
| 9,895,288 | B2 | 2/2018 | Augustini et al. | |
| 9,913,627 | B2 | 3/2018 | Ellis et al. | |
| 10,085,680 | B2 | 10/2018 | Crawford et al. | |
| 2004/0199126 | A1 | 10/2004 | Harding et al. | |
| 2007/0244456 | A1 | 10/2007 | Fangrow | |
| 2008/0121050 | A1 | 5/2008 | Sakai et al. | |
| 2010/0059474 | A1 * | 3/2010 | Brandenburger | A61J 1/1418 215/316 |
| 2010/0152674 | A1 | 6/2010 | Kavazov et al. | |
| 2011/0118676 | A1 | 5/2011 | Kropczynski, Jr. et al. | |
| 2011/0284413 | A1 | 11/2011 | Meise | |
| 2012/0136333 | A1 | 5/2012 | Hatalla | |
| 2013/0079744 | A1 | 3/2013 | Okiyama et al. | |
| 2014/0259724 | A1 | 9/2014 | McCarthy et al. | |
| 2014/0324011 | A1 | 10/2014 | Rettinghaus et al. | |
| 2017/0224860 | A1 | 8/2017 | Muller et al. | |
| 2019/0151200 | A1 | 5/2019 | McDowell | |
| 2020/0253827 | A1 | 8/2020 | Zhang et al. | |

FOREIGN PATENT DOCUMENTS

| | | | | |
|---|---|---|---|---|
| CN | 1878703 | A | 12/2006 | |
| CN | 101600411 | A | 12/2009 | |
| CN | 103459036 | A | 12/2013 | |
| CN | 103818646 | A | 5/2014 | |
| CN | 204582131 | U | 8/2015 | |
| CN | 105232331 | A | 1/2016 | |
| CN | 105879196 | A | 8/2016 | |
| CN | 205948043 | U | 2/2017 | |
| DE | 4317316 | A1 | 12/1994 | |
| DE | 20010825 | U1 | 11/2000 | |
| DE | 202009001068 | U1 | 4/2009 | |
| EP | 0379047 | A1 | 7/1990 | |
| EP | 1525918 | A2 | 4/2005 | |
| EP | 1825878 | A1 | 8/2007 | |
| JP | 53-19276 | | 2/1978 | |
| JP | 3-11648 | | 2/1991 | |
| JP | 5-77039 | | 10/1993 | |
| JP | 2008-237781 | A | 10/2008 | |
| JP | 2009-125162 | A | 6/2009 | |
| WO | 2005/004783 | A2 | 1/2005 | |
| WO | 2005/037659 | A2 | 4/2005 | |
| WO | 2015/106191 | A1 | 7/2015 | |
| WO | 2016/058662 | A1 | 4/2016 | |
| WO | WO-2016058662 | A1 * | 4/2016 | A61L 2/28 |
| WO | 2017/200992 | A1 | 11/2017 | |

OTHER PUBLICATIONS

International Search Report and Written Opinion for Application No. PCT/US2017/032824, dated Aug. 1, 2017, 7 pages.

International Search Report and Written Opinion for Application No. PCT/US2019/033518, dated Aug. 8, 2019, 21 pages.

* cited by examiner

SEALER-LESS PLASMA BOTTLE AND TOP FOR SAME

RELATED APPLICATION

This patent application is a continuation in part of and claims priority from all priority dates of PCT Application number PCT/US17/32824, filed May 16, 2017, entitled "Sealer-Less Plasma Bottle and Top for Same," and naming Christopher S. McDowell as inventor, the disclosure of which is incorporated herein, in its entirety by reference.

PCT Application number PCT/US17/32824 claims priority from U.S. Provisional Application No. 62/337,031, filed May 16, 2016, entitled "Sealer-Less Plasma Bottle and Top for Same," and naming Christopher S. McDowell as inventor, the disclosure of which is incorporated herein, in its entirety by reference.

This patent application also claims priority from U.S. Provisional Application No. 62/674,913, filed May 22, 2018, entitled "Sealer-Less Plasma Bottle and Top for Same," and naming Christopher S. McDowell and Matthew J. Murphy as inventors, the disclosure of which is incorporated herein, in its entirety by reference.

TECHNICAL FIELD

The present invention relates to blood component storage containers, and more particularly plasma storage containers.

BACKGROUND ART

Blood plasma is a straw-colored liquid component of whole blood, in which blood cells, such as red blood cells and white blood cells, and other components of the whole blood are normally suspended. Whole blood is made up of about 55%, by volume, plasma. Plasma plays important roles in a body's circulatory system, including transporting blood cells, conducting heat and carrying waste products. Pure plasma contains clotting factors, which increase the rate at which blood clots, making it useful in surgery and in the treatment of hemophilia. Banked whole blood is sometimes used to replace blood lost by patients during surgery or as a result of traumatic injuries. However, if banked whole blood that is compatible with the patient's blood type is not available, plasma may sometimes be used to replace some of the lost blood. Plasma additionally contains proteins that may be used to produce pharmaceuticals for immunodeficiency and other protein disorders. Furthermore, plasma may be frozen and stored for relatively long periods of time until it is needed.

To collect plasma, whole blood may be collected from a donor, and the plasma may be separated from the other components of the donated whole blood later, such as in a laboratory. However, in other cases, the plasma is separated from the other components of the whole blood at the donation site, and the other components are returned to the circulation system of the donor. For example, apheresis is a medical technology in which the blood of a donor or patient is passed through an apparatus, such as a centrifuge, that separates out one particular constituent and returns the remainder to the donor or patient. Plasmapheresis is a medical therapy that involves separating blood plasma from whole blood.

Collected plasma for pharmaceutical manufacturing is typically stored in plastic bottles. A typical plasma bottle includes two ports, one for introducing plasma into the bottle, and the other for venting air out of the bottle. Each of the ports typically extends from a surface of the plasma bottle (e.g., the top of the plasma bottle) and may have tubing connected to it. After plasma has been collected in the bottle, the tubing is cut off using radiofrequency sealing tongs, leaving short (typically about 1½ inch long) sealed tubing stubs attached to the ports extending from the plasma bottle. These stubs typically project from the bottle neck and may pose problems during transport and storage. For example, when the plasma is frozen, the plastic of the stubs and/or ports becomes brittle and may break, thereby violating the requirement to keep the plasma in a sealed container.

SUMMARY OF THE EMBODIMENTS

In a first embodiment of the invention there is provided a top for a plasma storage container. The top includes a top body that defines the structure of the top and seals an opening of the plasma storage container. The top may also include a first opening and a vent opening extending through the top body. A septum may be located at least partially within the first opening, and may include an aperture through it. The septum may allow a blunt cannula to pass through the aperture to access the interior of the plasma storage container. The top may also include a hydrophobic membrane located on underside of the top body. The membrane covers the vent opening and may allow air to move through the vent opening during filling of the plasma storage container while preventing ingress of undesirable microorganisms.

In some embodiments, the top may also include a skirt that extends downward from the underside of the top body around the first opening. The septum may be located and secured (e.g., via a swage connection) within the skirt. Alternatively, the septum may be overmolded with the skirt. The skirt and/or the swage connection may apply a compressive retaining force on the aperture. The aperture may be closed when the blunt cannula is not connected, and the first opening may be larger than the vent opening. Additionally or alternatively, the septum may allow a sample collection container holder to pass through the aperture to access the interior of the plasma collection container. For example, the sample collection container holder may be a vacutainer holder. The blunt cannula may be part of a tubing set connected to a blood processing device.

The top body may also include at least one flow channel on the underside of the top body. The at least one flow channel may be in fluid communication with the vent opening to allow airflow in and out of the plasma storage container via the vent opening. The surface area of the hydrophobic membrane may be larger than a cross-sectional area of the vent opening, and/or the hydrophobic membrane may be sealed and/or ultrasonically welded to an energy director on the underside of the top body. The top may include a retaining element (e.g., a clip) located on a top surface of the top body. The retainer may hold the blunt cannula in place during filling of the plasma storage container.

In accordance with additional embodiments, a plasma storage container includes a container body that defines the structure of the plasma storage container and defines an interior. The container includes a top configured to seal an opening of the plasma storage container. The top may include a first opening and a vent opening extending through the container top. A septum may be located at least partially within the first opening and may include a pre-pierced aperture therethrough. The septum/aperture allows a blunt cannula to pass through the aperture to access the interior of the plasma storage container. The container also includes a hydrophobic membrane located on underside of the container top. The membrane covers the vent opening and allows air to pass through the vent opening during plasma collection. The first opening may be larger than the vent opening.

In some embodiments, the plasma storage container may include a skirt that extends from the underside of the container top around the first opening. The septum may be located and secured within the skirt, for example, via a swage connection. Additionally or alternatively, the septum may be overmolded within the skirt. The skirt and/or the swage connection may apply a radially inward force on the aperture that biases the aperture closed. The aperture may be closed when the blunt cannula is not connected.

The container top may include at least one flow channel on an underside of the container top. The flow channel(s) may be in fluid communication with the vent opening to allow airflow in and out of the plasma storage container via the vent opening. The surface area of the hydrophobic membrane may be larger than a cross-sectional area of the vent opening. Additionally or alternatively, the hydrophobic membrane may be ultrasonically welded to the underside of the container top and/or may be sealed to the underside of the container top.

In further embodiments, the plasma storage container may include a retainer located on a top surface of the container top. The retainer may hold the blunt cannula in place during filling of the plasma storage container, and/or may be a clip. In other embodiments, the septum may allow a sample collection container holder (e.g., a vacutainer holder) to pass through the aperture to access the interior of the plasma collection container. The blunt cannula may be part of a tubing set connected to a blood processing device.

In accordance with additional embodiments, a top for a plasma storage container may include a top body that defines the structure of the top and seals an opening of the plasma storage container. The top may also include a first opening and a vent opening extending through the top body. A valve mechanism may be located at least partially within the top body. The valve mechanism may have an aperture therethrough that opens upon connection of a blunt cannula to the plasma storage container (e.g., thereby providing access the interior of the plasma storage container). The top may also have a vent filter that allows air to vent through the vent opening during filling of the plasma storage container.

The valve mechanism may include a septum and the aperture may extend through the septum. The aperture may allow the blunt cannula to at least partially enter the aperture after connection of the blunt cannula to the plasma storage container. In some embodiments, the top may include a skirt extending from the underside of the top body and around the first opening. The septum may be located and secured within the skirt (e.g., via swage connection). The skirt and/or the swage connection may apply a radially inward force on the septum to keep the septum secured within the skirt.

In further embodiments, the valve mechanism may include a resilient member that has (1) a septum located nearer the top of the resilient member and (2) a valve wall that extends downward from the septum. The aperture may extend through the septum, and the valve wall may form a valve interior. Additionally, the top may include a valve housing that extends from a top surface of the top. The valve mechanism may at least partially be located within valve housing. The valve housing may include an inlet portion. The septum may be located at least partially within the inlet portion, and an inner surface of the inlet portion may include a luer taper. A cap may be placed over at least a portion of the inlet portion, and the cap may provide a sterile barrier for the first opening prior to connection of the blunt cannula.

The valve housing may also include a second portion that is located below the inlet portion. The second portion may have an inner diameter that is greater than an inner diameter of the inlet portion. Additionally or alternatively, the second portion may have an inner diameter that expands along a length of the second portion. Connection of the blunt cannula to the plasma storage container may cause the septum to move from the inlet portion of the valve housing to the second portion (e.g., to allow the aperture to open).

In still further embodiments, the valve housing may include a locking mechanism that locks the blunt cannula to the valve housing. For example, the locking mechanism may include luer threads. Additionally or alternatively, the blunt cannula may have a skirt and threads within the skirt. The skirt threads may engage the luer threads on the valve housing. The first opening may be larger than the vent opening.

The vent filter may include a hydrophobic membrane that is located on the underside of the top body and covers the vent opening. The top body may include at least one flow channel on the underside of the top body. The flow channel(s) may be in fluid communication with the vent opening to allow airflow in and out of the plasma storage container via the vent opening. A surface area of the hydrophobic membrane may be larger than a cross-sectional area of the vent opening, and the hydrophobic membrane may be sealed to the underside of the top body.

In other embodiments, the vent filter may include a plug filter. For example, the plug filter may be a self-sealing filter that seals the vent opening upon exposure of the plug filter to liquid. The top may include a vent skirt extending from the top body (e.g., from the underside of the top body) and around the vent opening. The plug filter may be located and secured within the vent skirt. Also, the top may include at least one splash guard extending from the vent skirt. The splash guard may prevent liquid from contacting the plug filter during filling of the plasma storage container.

In additional embodiments, the top may include a removable sterile barrier seal that covers the first opening prior to connection of the blunt cannula. On the top surface, the top may include a retainer (e.g., a clip) that holds the blunt cannula in place during filling of the plasma storage container. The blunt cannula may be part of a tubing set connected to a blood processing device. The tubing set may include a connector configured to connect to a blood component separation device and a cap secured to the connector via a tether. The blunt cannula may be secured to the tether prior to use. The cannula may include a grasping element configured to allow a user to grasp the cannula during use. The top may also include at least one stiffening rib located on an underside of the top.

In accordance with further embodiments, a top for a plasma storage container includes a top body that defines the structure of the top and seals an opening of the plasma storage container. The top also has an inlet opening extending through the top body and a valve mechanism located at least partially within the inlet opening. The valve mechanism has an aperture that is configured to open upon connection of a cannula to the plasma storage container (e.g., to provide access to the interior of the plasma storage container). A locking mechanism locks the cannula to the top, and the top may have a vent opening extending through the top body. A vent filter allows air to vent through the vent opening during filling of the plasma storage container.

The valve mechanism may include and/or be a septum and the top may have a skirt extending from the underside of the top body and around the first opening. The septum may be located and secured within the skirt (e.g., via a swage connection). The skirt and/or the swage connection may apply a radially inward force on the septum to keep the septum secured within the skirt. The aperture may be closed when the blunt cannula is not connected and may allow the cannula to at least partially enter the aperture after connection of the cannula to the plasma storage container.

The locking mechanism may include a locking protrusion extending from the top body and into the inlet opening. The locking protrusion may snap into a recess within the cannula during connection of the cannula. The cannula may include a cannula protrusion that extends from a surface of the cannula, and the locking protrusion may snap over the cannula protrusion into the recess during connection of the cannula. At least one surface of the locking protrusion may be angled to allow the locking protrusion to snap over the cannula protrusion.

In some embodiments, the top may include a cannula support structure that extends from a top surface of the top and defines a channel configured to support the cannula when connected to the plasma storage container. The cannula support structure may include a camming surface, and rotation of the cannula may cause the cannula to slide up the camming surface. This, in turn, causes the locking protrusion to snap out of the recess and disconnects the cannula from the plasma storage container.

To provide a sterile barrier for the inlet opening prior to connection of the cannula, the top may have a cap that connects to the inlet opening. The cap may have a lower portion that extends into the inlet opening when connected to the plasma storage container, and a mating portion that mates with at least a portion of the channel of the cannula support structure. The cannula may have a grasping element that allows a user to grasp the cannula during use and/or the grasping element may include a clamp.

The cannula may be part of a tubing set connected to a blood processing device. For example, the tubing set may include a connector configured to connect to a blood component separation device and a cap secured to the connector via a tether. The cannula may be secured to the tether prior to use.

In some embodiments, the inlet opening may be larger than the vent opening and/or the vent opening may include a hydrophobic membrane that is located on an underside of the top body and covers the vent opening. The top body may have at least one flow channel on the underside of the top body. The flow channel may be in fluid communication with the vent opening to allow airflow in and out of the plasma storage container via the vent opening. The surface area of the hydrophobic membrane may be larger than a cross-sectional area of the vent opening and/or the hydrophobic membrane may be sealed to the underside of the top body.

In other embodiments, the vent filter may include a plug filter. The plug filter may be a self-sealing filter configured to seal the vent opening upon exposure of the plug filter to liquid. In such embodiments, the top may include a vent skirt extending from the top body (e.g., from the underside) around the vent opening. The plug filter may be located and secured within the vent skirt. The top may also have at least one splash guard that extends from the vent skirt. The splash guard may prevent liquid from contacting the plug filter during filling of the plasma storage container.

On the top surface, the top may have a retainer (e.g., a clip) that holds the blunt cannula in place during filling of the plasma storage container. The valve mechanism may also allow a sample collection container holder (e.g., a vacutainer holder) to pass through the aperture to access the interior of the plasma collection container. The top may have at least one stiffening rib located on an underside of the top.

In some embodiments, the valve mechanism may include a resilient member with (1) a septum located nearer the top of the resilient member and (2) a valve wall that extends downward from the septum. The aperture may extend through the septum, and the valve wall may form a valve interior. The top may have a valve housing that extends from a top surface of the top. The valve mechanism may be located, at least partially, within the valve housing. The valve housing may have an inlet portion and the septum may be located at least partially within the inlet portion. The inner surface of the inlet portion may have a luer taper.

The valve housing may also include a second portion located below the inlet portion. The second portion may have an inner diameter that is greater than an inner diameter of the inlet portion and/or the second portion may have an inner diameter that expands along a length of the second portion. Connection of the blunt cannula to the plasma storage container may cause the septum to move from the inlet portion of the valve housing to the second portion to allow the aperture to open. The locking mechanism may be on the valve housing. For example, the locking mechanism may include luer threads. The blunt cannula may have a skirt and threads within the skirt. The threads may engage the luer threads on the valve housing.

In accordance with additional embodiments, a plasma storage container has (1) a container body that defines the structure of the plasma storage container and an interior, and (2) a container top that seals an opening of the plasma storage container. The container may also have an inlet opening extending through the top body and a valve mechanism located at least partially within the inlet opening. The valve mechanism may have an aperture that opens upon connection of a cannula to the plasma storage container (e.g., to provide access to the interior of the plasma storage container). The container/top also has (1) a locking mechanism, (2) a vent opening extending through the top body, and (3) a vent filter. The locking mechanism may lock the cannula to the top. The vent filter allows air to vent through the vent opening during filling of the plasma storage container.

BRIEF DESCRIPTION OF THE DRAWINGS

The foregoing features of embodiments will be more readily understood by reference to the following detailed description, taken with reference to the accompanying drawings, in which.

DETAILED DESCRIPTION OF SPECIFIC EMBODIMENTS

Figure 1:
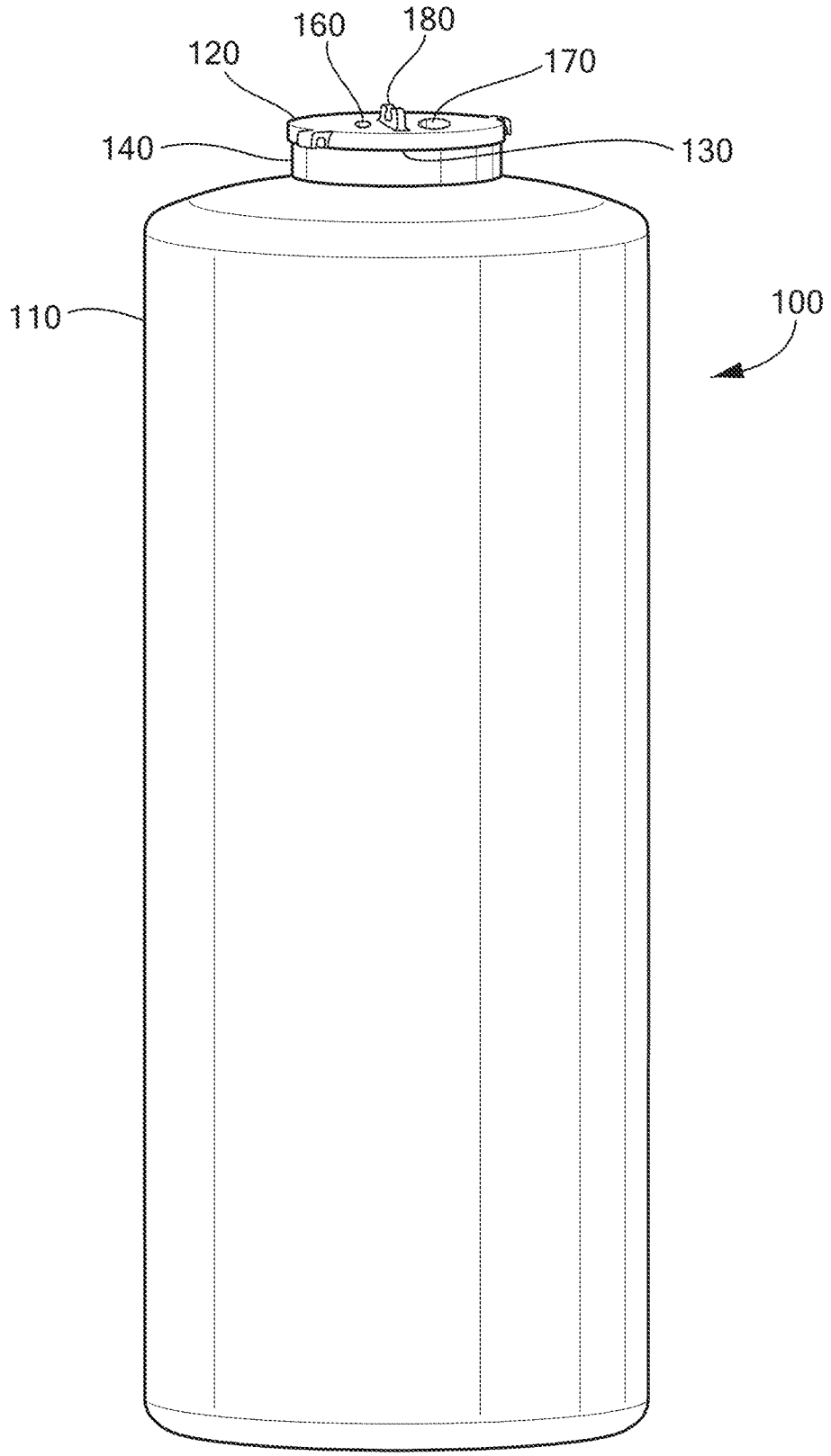
FIG. 1 schematically shows a perspective view of a plasma storage container, in accordance with embodiments of the present invention.

FIG. 1 is a perspective view of a blood plasma container 100, according to an embodiment of the present invention. The plasma container 100 may have a body portion 110 and a top 120 that closes an opening 130 (e.g., an open end in the body portion 110 at the proximal end 140 of the plasma container 100). As discussed in greater detail below, plasma may be collected within the plasma container 100 and sampled through the top 120. The body portion 110 defines an interior volume 150 (e.g., an interior) in which the collected plasma can be stored.

Figure 2:
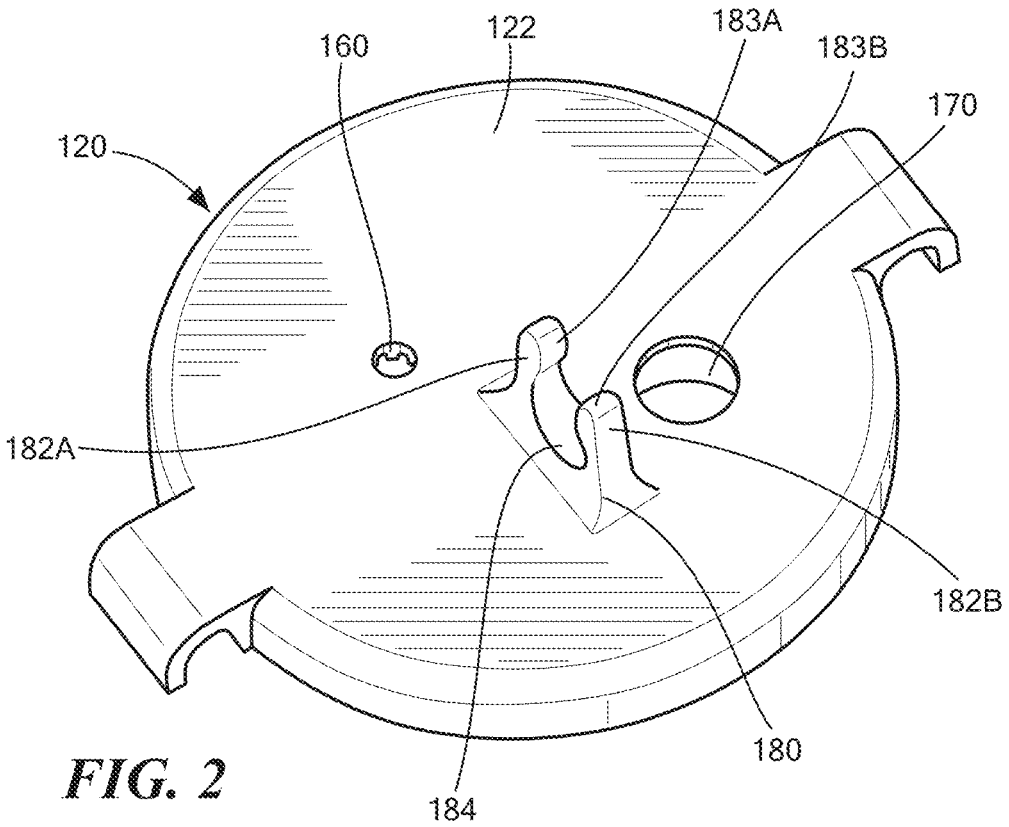
FIG. 2 schematically shows a top perspective view of a top, without a septum and hydrophobic membrane installed, for the plasma storage container shown in FIG. 1, in accordance with embodiments of the present invention.
Figure 3:
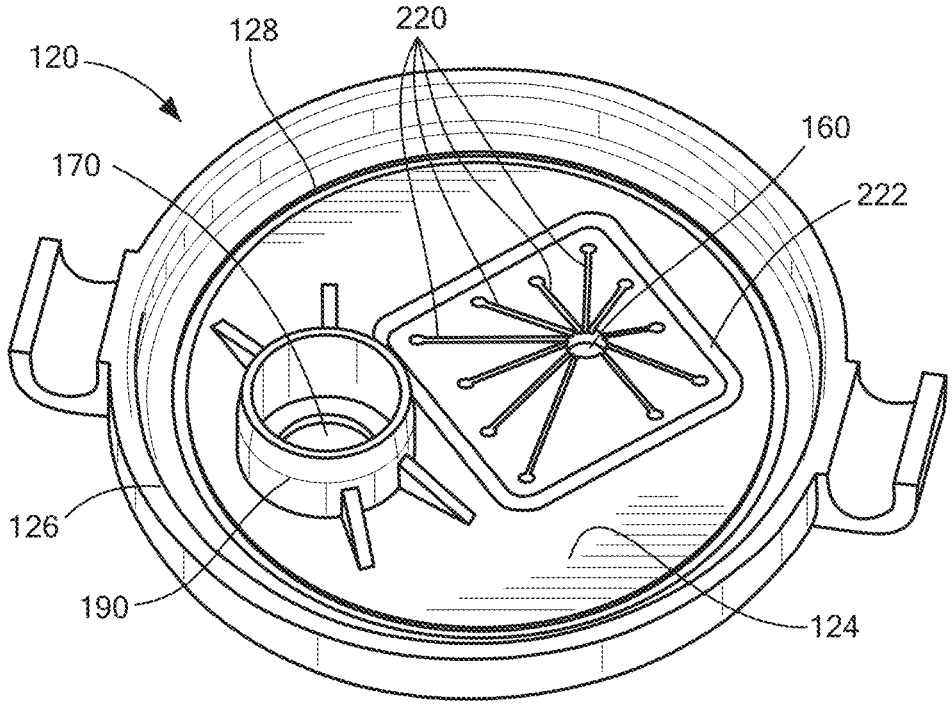
FIG. 3 schematically shows a bottom perspective view of a top, without a septum and hydrophobic membrane installed, for the plasma storage container shown in FIG. 1, in accordance with embodiments of the present invention.

As shown in FIGS. 2 and 3, the top 120 includes a vent hole 160 through which air may pass bidirectionally during plasma collection 100, and an inlet hole 170 through which the plasma may be transferred into the plasma container 100. The size of the vent hole 160 and the inlet hole 170 may vary depending on the application, but, in some embodiments, the inlet hole 170 may be substantially larger the vent hole 160. Additionally, the top 120 may include a retainer 180 extending from a top surface 122 of the top. As discussed in greater detail below, the retainer 180 may be used to secure a blunt cannula (which, in turn, is used to transfer plasma into the container 100) to the top 120 of the plasma container 100 while plasma is being collected within the container 100. The retainer 180 may be any number of components capable of securing the blunt cannula (e.g., a standard male luer). For example, the retainer 180 may be clip with two proximally extending protrusions 182A/B that define a space 184 between them in which the cannula may reside. In such embodiments, the user may push the cannula into the retainer/clip 180 until it snaps/clicks into the space 184. To hold the cannula in place within the clip 180, the protrusions 182A/B may include inward projections 183A/B that extend over the cannula when it is located within the space 184.

Figure 4:
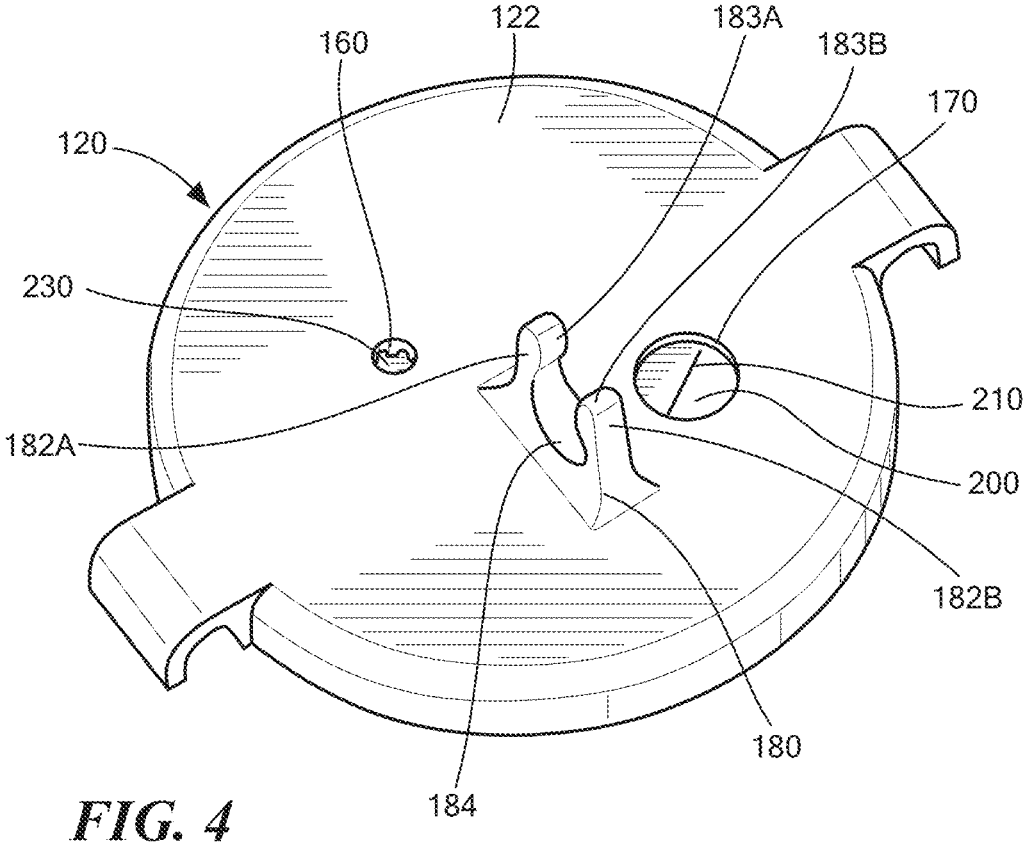
FIG. 4 schematically shows a top perspective view of a top, with a septum and hydrophobic membrane installed, for the plasma storage container shown in FIG. 1, in accordance with embodiments of the present invention.
Figure 5:
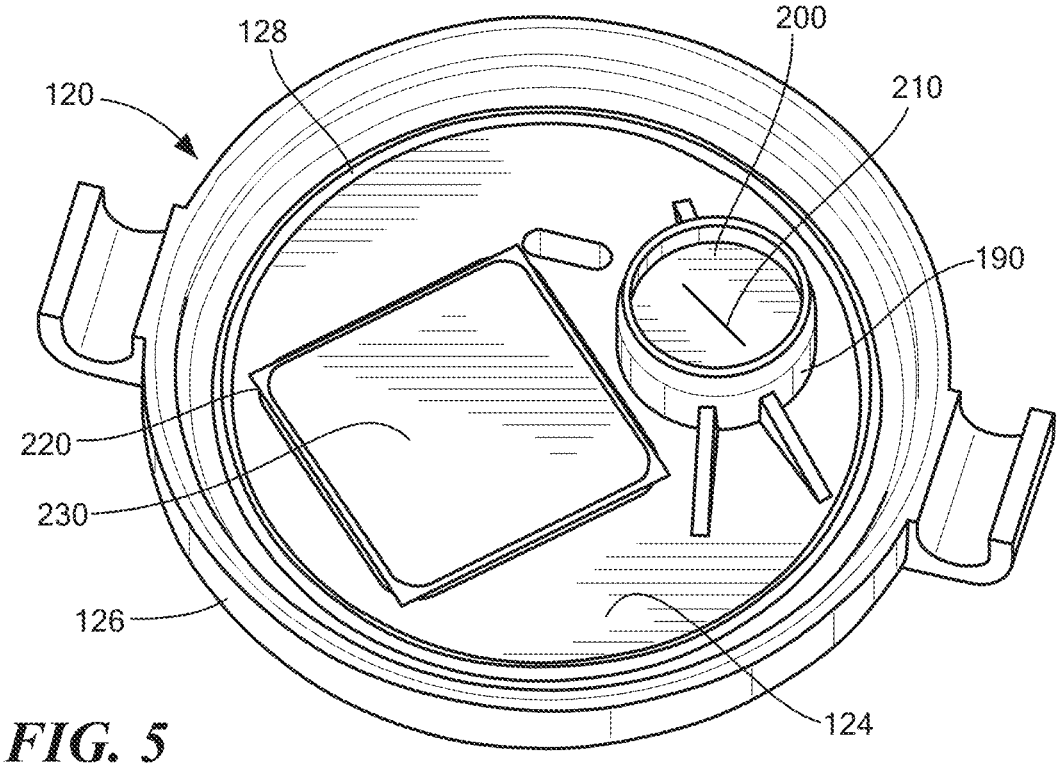
FIG. 5 schematically shows a bottom perspective view of a top, with a septum and hydrophobic membrane installed, for the plasma storage container shown in FIG. 1, in accordance with embodiments of the present invention.

On the underside 124, the top 120 may include a skirt 190 that extends distally from the top 120 (e.g., downward from the top 120) and around the inlet opening 170. To help maintain the sterility of the container 100 and keep the inlet opening 170 closed when the container is not being filled with plasma (e.g., before and after filling), the top 120 may include a valve mechanism. For example, the top may include a septum 200 located and secured within the skirt 190. As best shown in FIGS. 4 and 5, the septum 200 may have an aperture 210 extending through the body of the septum 200. The aperture 210 may be normally closed (e.g., closed when in its natural state and not subject to any external pressures) and/or the aperture 210 may be held closed by a radially compressive force applied to the septum 200 by the skirt 190. For example, the septum 200 may be swaged into the skirt 190. As is known in the art, when the septum 200 is swaged within the skirt 190, a portion of the skirt 190 (e.g., the bottom of the skirt) may be compressed into the septum 200. This creates a compressive force that keeps the septum 200 in the skirt 190. Additionally or alternatively, the outer diameter of the septum 200 may be larger than the inner diameter of the skirt 190 and the septum 200 may be press-fit into the skirt 190. This press-fit will create the radially inward force that keeps the aperture 210 closed.

It should be noted that, although the aperture 210 is shown as a slit within FIGS. 4 and 5, other aperture configurations may be used. For example, the aperture 210 may consist of two slits formed into a cross shape. Alternatively, the aperture 210 can have more than two slits in the shape of a star or asterisk. It is important to note that the aperture 210 (e.g., the one or more slits) may be formed, for example, using traditional cutting means (e.g., razor blade, knife, etc.), piercing with a needle, or ultrasonic cutting methods. Additionally or alternatively, the aperture 210 could also be formed in-mold during or after the injection molding process.

To provide a sterile barrier for the vent hole 170, the top may include a vent filter. For example, also on the underside 124, the top 120 may include a hydrophobic membrane 230 located under the vent hole 160 such that the hydrophobic membrane 230 may provide a sterile barrier for the vent hole 160. During filling of the plasma container 100, the hydrophobic membrane 230 will allow air to pass through the membrane 230 and the vent hole 160 to prevent atmospheric pressure differentials from building up in the container 100. To help with air flow, the top may also include a number of channels 220 within the surface under the hydrophobic membrane 230. The channels 220 can extend to the edge of the vent hole 160 and allow air pass through the membrane 230, for example, even if the membrane 230 is pushed against the underside 124 of the top 120 (e.g., during high-air-flow-rate periods).

The hydrophobic membrane 230 may be ultrasonically welded to the top 120 (or otherwise sealed to the top 120) to prevent air from leaking past the hydrophobic membrane 230. To that end, the top 120 may include an energy director 222 for use during the ultrasonic welding process to ensure that the hydrophobic membrane 230 is properly sealed and secured to the underside 124 of the top 120. Alternatively, the membrane 230 may be secured to the top 120 via other joining methods including, but not limited to, adhesives, hot melt glue, and laser welding.

As shown in FIG. 5, to maximize the surface area of the hydrophobic membrane 230 and to ensure that the hydrophobic membrane 230 can handle the required flowrate of air in and out of the container 100, the hydrophobic membrane 230 may be sized such that it is substantially larger than the vent opening/hole 160. Additionally, to further maximize the use of membrane material, the hydrophobic membrane 230 may be square.

It should be noted that the top 120 and container body 110 may be formed as two separate pieces and then secured together via ultrasonically welded together. To help facilitate the ultrasonic welding, the top 120 may include a distally extending wall 126 that extends over the top of the container body 110 when the top 120 is placed on the body 110 (e.g., over the proximal end 140 of the body 110). Additionally, on the underside 124, the top 120 may include an energy director 128 to aid in the ultrasonic welding process (e.g., to secure the top 120 to the body 110).

Figure 6:
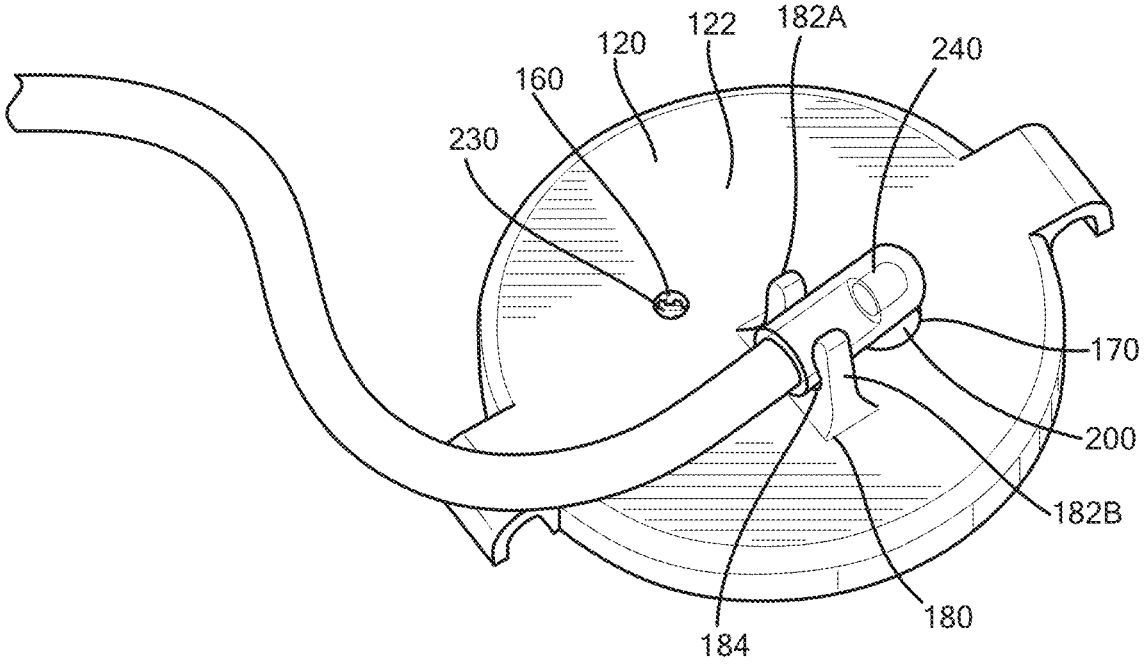
FIG. 6 schematically shows a top perspective view of a top, with a blunt cannula inserted into the septum, for the plasma storage container shown in FIG. 1, in accordance with embodiments of the present invention.
Figure 7:
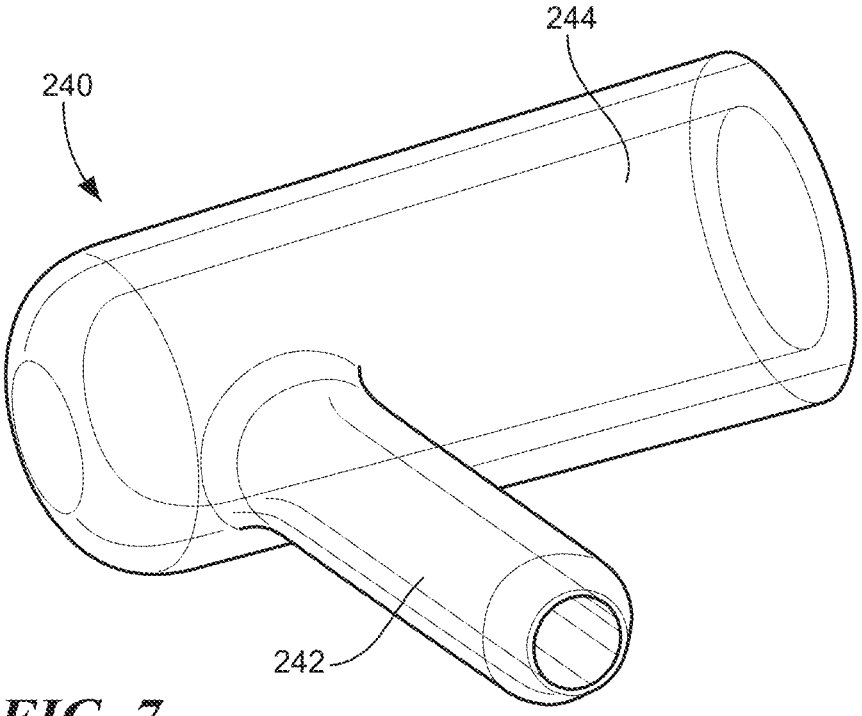
FIG. 7 schematically shows an exemplary blunt cannula for use with the plasma collection container of FIG. 1, in accordance with embodiments of the present invention.
Figure 8:
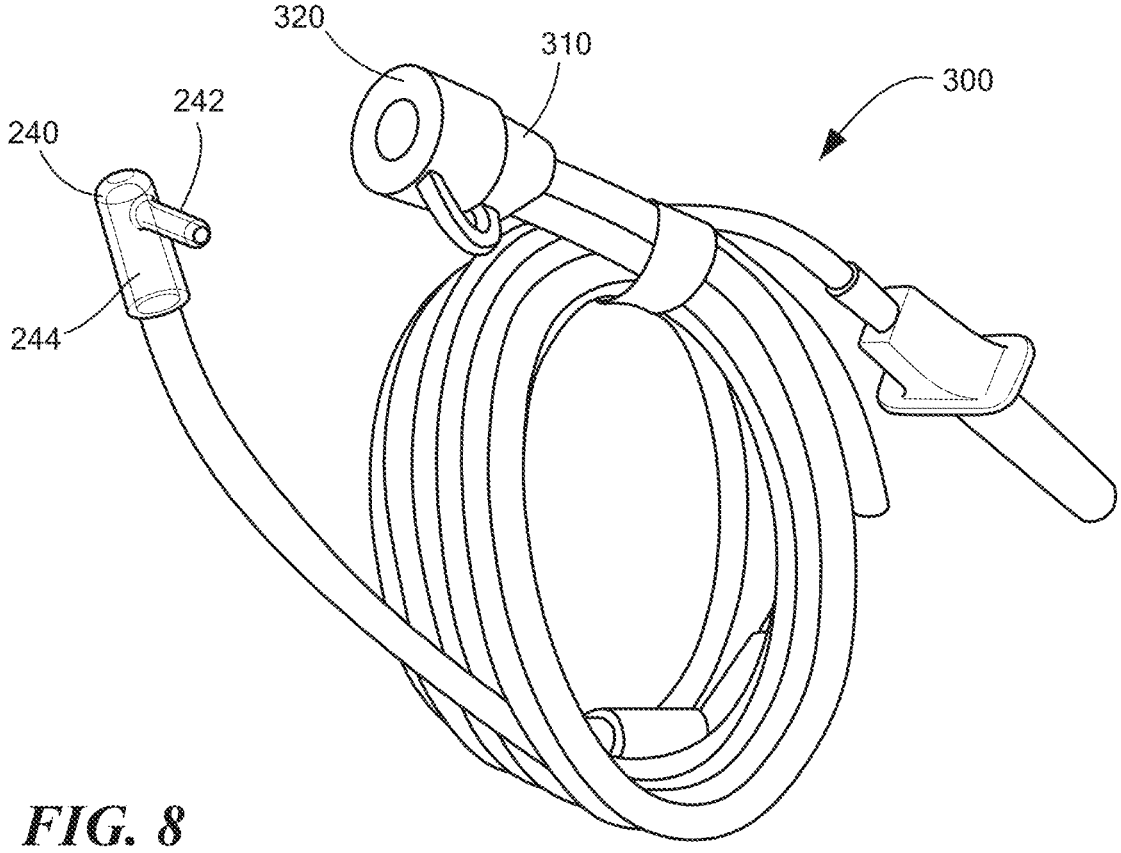
FIG. 8 schematically shows an exemplary tubing set containing the blunt cannula of FIG. 7, in accordance with embodiments of the present invention.

During use and plasma collection, the user may connect the plasma container 100 to a blood processing device via the blunt cannula 240 (FIG. 7) and a tubing set 300 (FIG. 8) on which the blunt cannula 240 may be located. For example, the user may connect the blood processing device connector 310 at one end of the tubing set 300 to the blood processing device (not shown), and the blunt cannula 240 on the other end of the tubing set 300 to the plasma container 100. To connect the blunt cannula 240 to the plasma container 100, the user may insert the outlet portion 242 of the cannula 240 into the septum 200 and through the aperture 220. This will allow the cannula 240 to access the interior volume 150 of the container 100 and create fluid communication between the interior volume 150 and the tubing set 300 (e.g., and the outlet of the blood processing device). The user may then snap the body 244 of the cannula 240 into the retainer 180 to hold the cannula 240 in place on the top 120 (FIG. 6).

As the blood processing device separates the plasma from whole blood and sends the plasma to the storage container 100, the plasma may flow through the tubing set 300 and into the interior volume 150 of the container 100 via the blunt cannula 240. As the plasma flows into the container 100, air will exit the container 100 through the hydrophobic membrane 230 and the vent hole/opening 160. This, in turn, will prevent pressure from building up within the container 100. As needed/required by the blood processing device, air may also enter the container 100 through hydrophobic/sterilizing membrane 230 and the vent hole/opening 160. This, in turn, will prevent vacuum from building up within the container 100.

Figure 9:
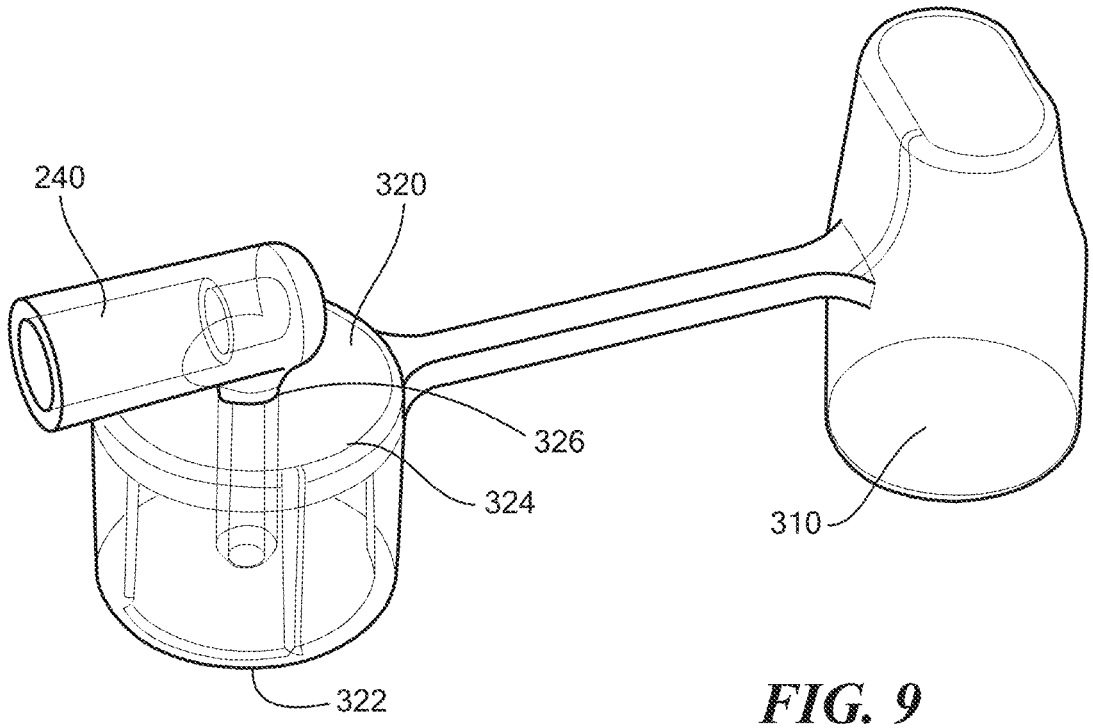
FIG. 9 schematically shows an exemplary cap for the tubing set shown in FIG. 8 with the blunt cannula inserted, in accordance with embodiments of the present invention.

In order to aid in storage and to ensure that the opening in the outlet portion 242 of the cannula 240 is covered and not exposed to the atmosphere, the tubing set 300 may include a cap 320 that can be used for both the blood processing device connector 310 and the outlet portion 242 of the cannula 240 (FIG. 9). For example, the cap 320 may have an open end 322 that may be placed over the blood processing device connector 310 when not in use. Additionally, the top 324 of the cap 320 may have an opening 326 in which the outlet portion 242 of the cannula 240 may be inserted. In some embodiments, the cap 320 may be tethered to the blood component device connector 310.

Once the plasma has been collected within the container 100, there may be a need to sample the collected plasma at various times (e.g., after collection, sometime during storage, prior to use). To that end, the user may insert a sample collection container holder (e.g., a vacutainer holder) into the septum 200/aperture 210 to access the volume of plasma within the container 100. The user may then turn the container 100 upside down and connect a vacutainer to the holder to begin collecting a sample of plasma within the vacutainer. It should be noted that collecting the plasma sample in this manner provides the most representative sample of the plasma in the container 100 possible and minimizes/eliminates any loss of plasma, where residual plasma might otherwise be lost in sampling means that involve sampling through tubing external to the top 120.

Figure 10A:
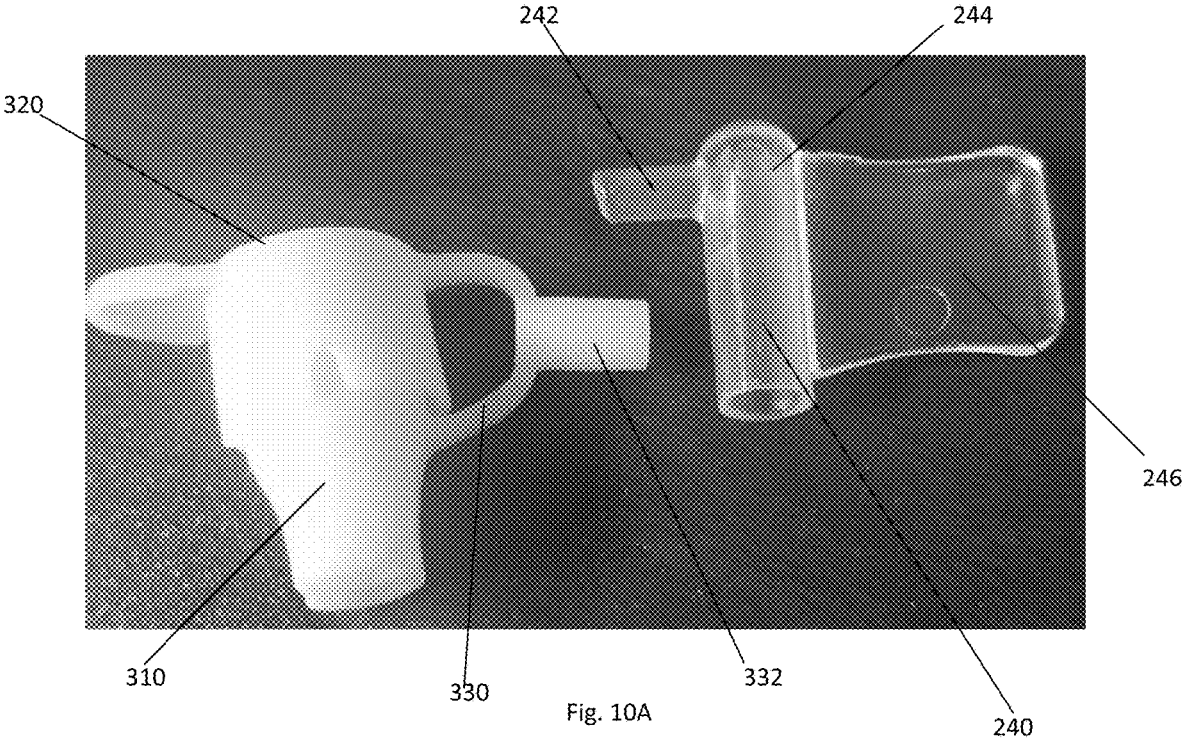
FIGS. 10A and 10B schematically show an alternative cap for the tubing set shown in FIG. 8, in accordance with additional embodiments of the present invention.
Figure 10B:
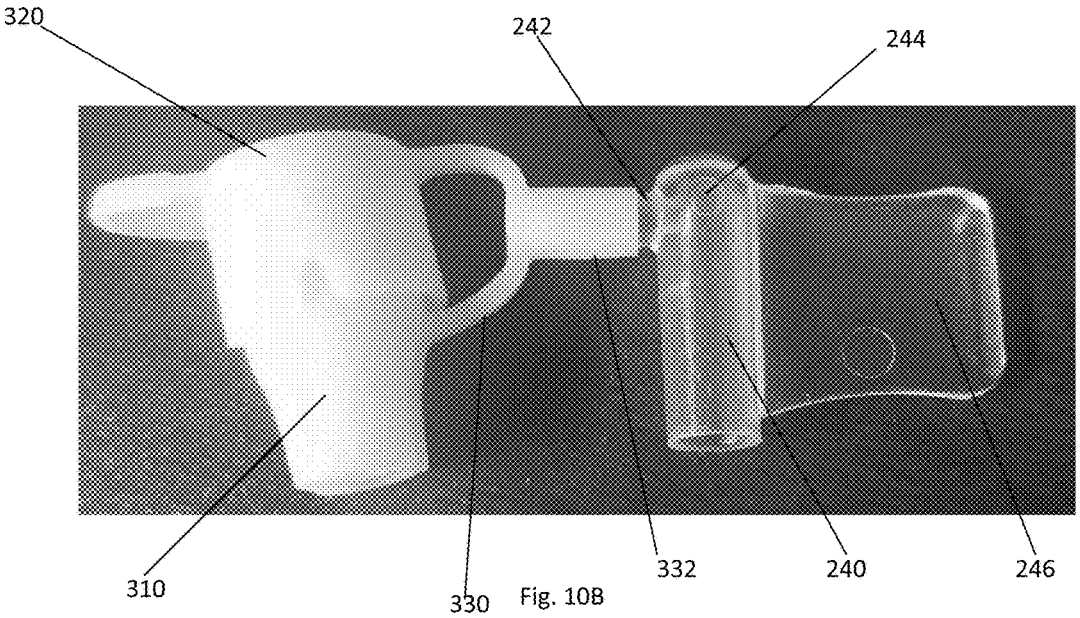

It is important to note that the outlet portion 242 of the cannula 240 need not be located within the cap 320 prior to use and may be located elsewhere. For example, as shown in FIGS. 10A and 10B, the tether 330 that secures the cap 320 to the blood processing device connector 310 may include a cup 332 in which the outlet portion 242 of the cannula 240 may be inserted prior to use. In such embodiments, the outlet portion 242 of the cannula 240 may remain covered even after the user has disconnected the cap 320 and connected the blood processing device connector 310 to the blood processing device. Additionally, after use, the outlet portion 242 of the cannula 240 may be reinserted into the cup 332 even if the connector 310 is still connected to the blood processing device.

As also shown in FIGS. 10A and 10B, the cannula 240 may also include a grasping element 246 (e.g., a fin or similar structure) that extends from the body 244 of the cannula 240. In such embodiments, the grasping element may be used to hold and manipulate the cannula 240 during removal of the cannula 240 from the cap 320 or cup 332 within the tether and during connection of the cannula 240 to the plasma container 100. The grasping element 246 may be sized to allow the user to grasp (e.g., using their thumb and forefinger) the cannula 240.

Figure 11A:
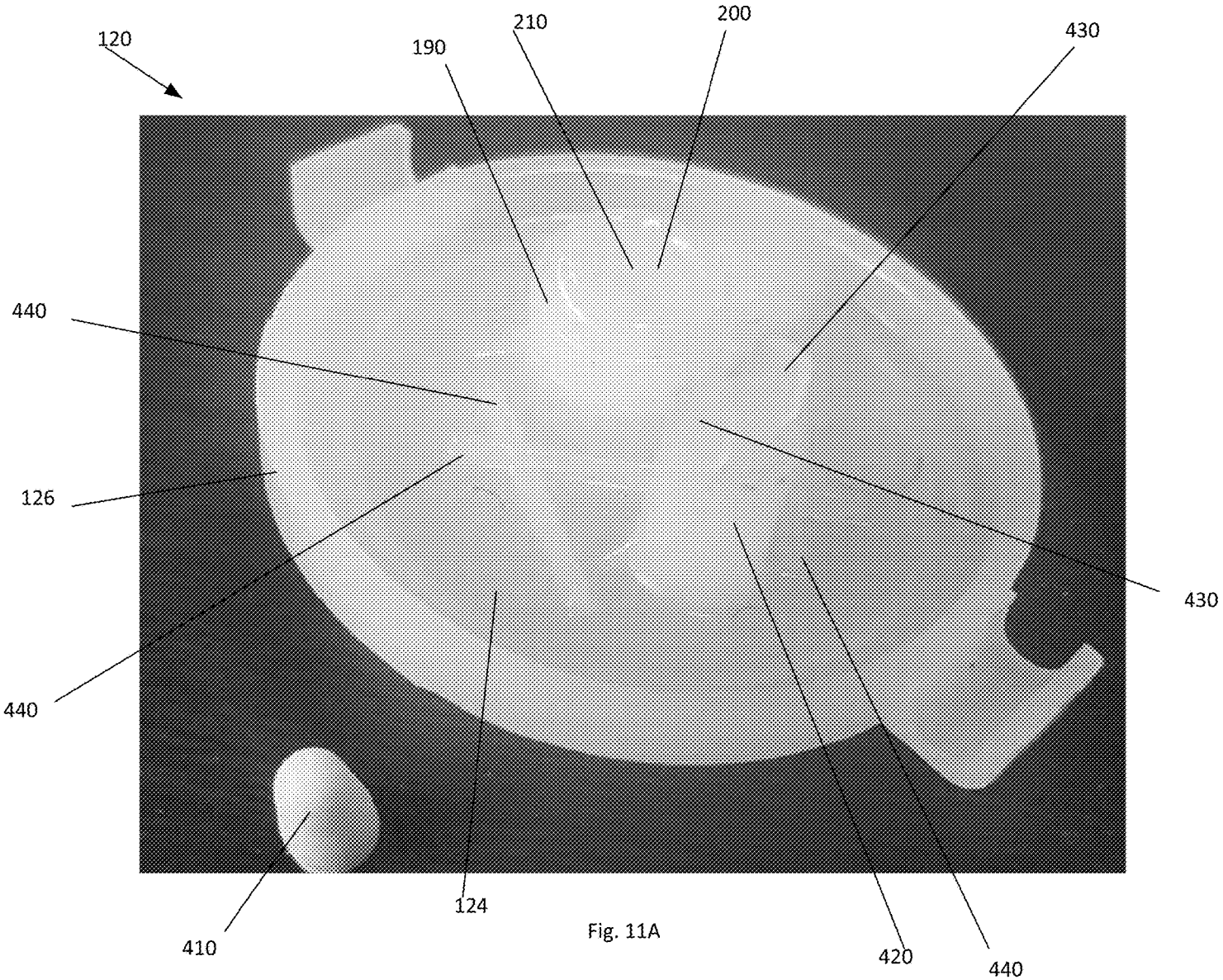
FIGS. 11A to 11C schematically show an alternative top for the plasma storage container, in accordance with further embodiments of the present invention.
Figure 11B:
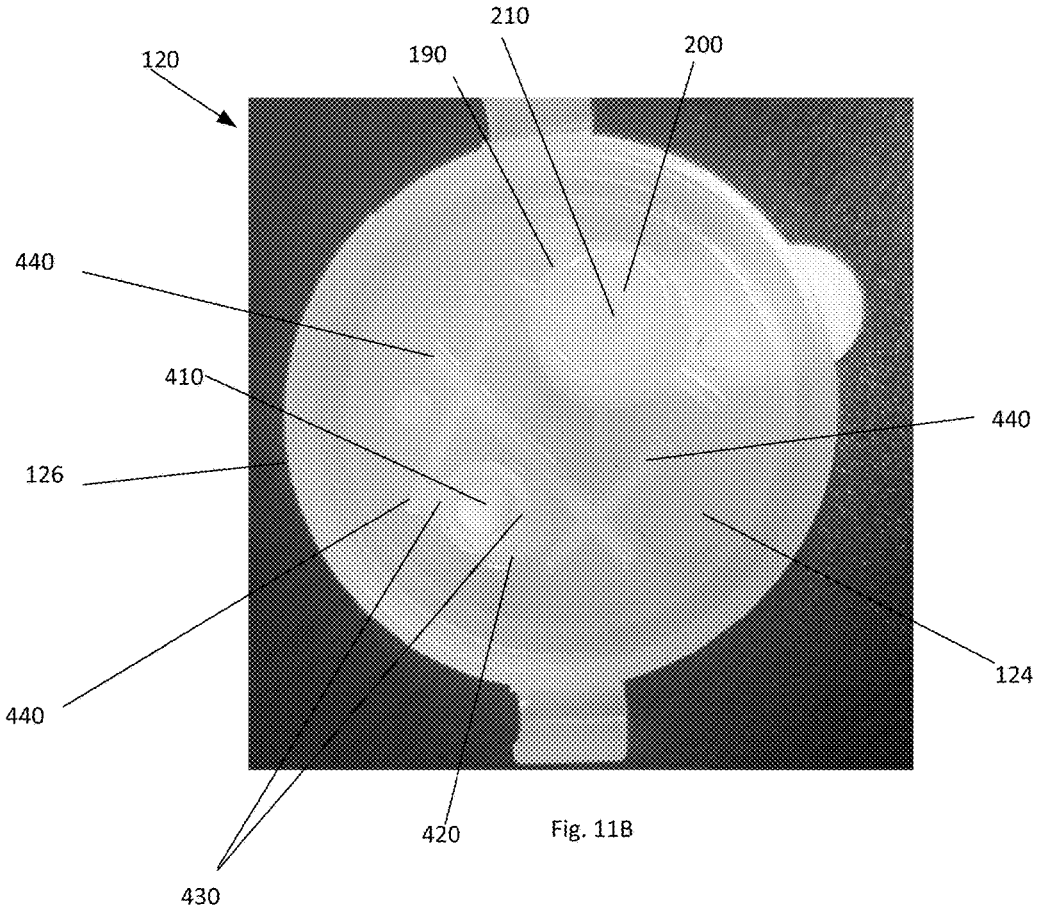
Figure 11C:
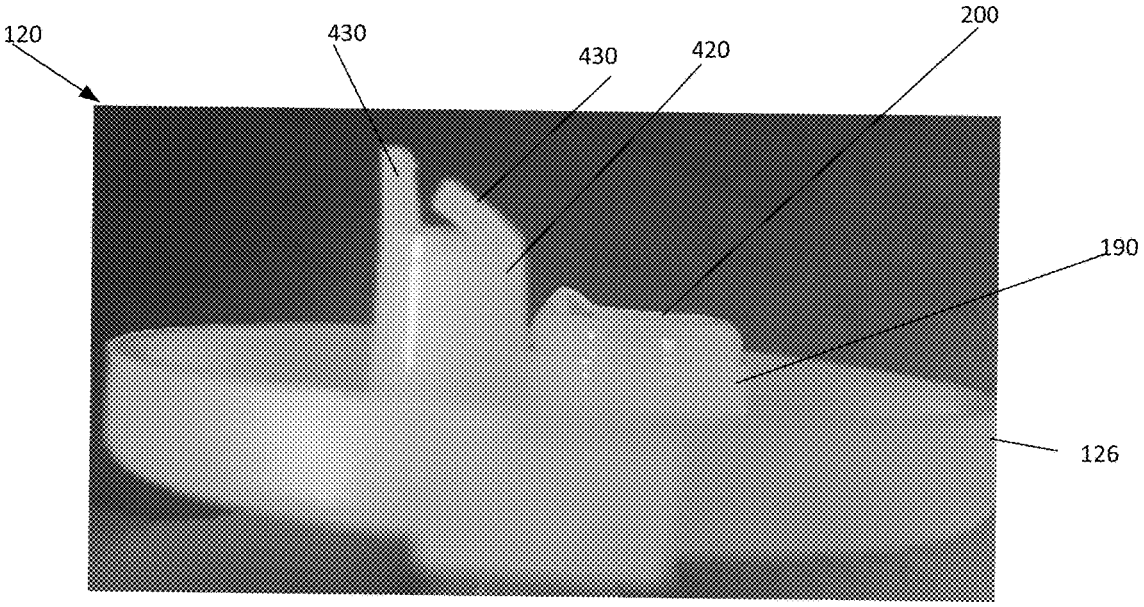

Although the embodiments described above use a hydrophobic membrane 230 as the vent filter, other embodiments may utilize different vent filters. For example, as shown in FIGS. 11A to 11C, some embodiments may utilize a plug type filter 410. In such embodiments, the top 120 may have a vent skirt 420 that extends from (e.g., extends downward from) the underside 124 of the top 120 and in which the plug filter 410 is located. The plug filter 410 may be secured within vent skirt 420 in any number of ways including, but not limited to press-fit or swaged.

It should be noted that the plug filter 410 can be any number filter types that allows air to vent through the vent hole 160 and provides a sterile barrier. In some embodiments, the plug filter 410 can be a hydrophobic filter like the membrane 230 discussed above and/or the plug filter 410 can be a Porex™ plug filter. Additionally or alternatively, in other embodiments, the plug filter 410 may be a self-sealing filter (also sold by Porex™) that swells upon contact with a liquid to seal the vent hole 160 and prevent the liquid within the plasma container 100 from leaking out of the vent hole 160. For example, once the plasma collection process is complete, and the user turns the container 100 upside to collect a sample (discussed above), the plasma will contact plug filter 410 causing it to self-seal and preventing the plasma from leaking out of the vent hole 160.

In some embodiments, particularly those using self-sealing plug filters, it may be beneficial to minimize the risk of fluid (e.g., plasma) contacting the vent filter (e.g., the plug filter 410) during filling of the plasma container 100. To that end, the top 120 may have one or more splash guards 430 that protect the plug filter 410 from any splashing or foaming within the plasma container 100 during filling. For example, as best shown in FIGS. 11A-11C, the splash guards 430 may extend downward from the bottom of the vent skirt 420. One or more of the splash guards (e.g., the one closet to the inlet 170) may be angled to better prevent any droplets of plasma (or foam) from reaching the plug filter 410. Also, it should be noted that, although FIGS. 11A-11C show two splash guards 430, other embodiments may have only a single splash guard 430 or more than two splash guards 430.

As best shown in FIGS. 11A and 11B, the underside 124 of the top 120 can have a number of structures that help stiffen the top 120. For example, the top 120 may include stiffening ribs 440 on the underside 124 of the top 120. The ribs 440 may be asymmetric and irregular to help prevent nodal vibrations with resonance in the top 120 during the ultrasonic weld process (e.g., to secure the top 120 to the plasma container 100).

FIGS. 12A-12E show a top 120 for a plasma storage container 100 with an alternative valve mechanism, for example, a needleless valve. In such embodiments, in addition to the skirt 190 that extends from the underside 124 of the top 120, the top 120 can include a valve housing 510 that extends upward from the top surface 122 of the top 120. The valve housing 510 may form an interior 512 in which the valve mechanism may be located and may have an inlet portion 514 with an internal geometry that complies with a standard luer taper (e.g., the internal diameter of the inlet portion 514 may be tapered to comply with luer standards). The inlet 170 may be located at the proximal end of the inlet portion 514 such that upon connection of the cannula 240, a portion of the cannula 240 will enter the inlet portion 514 of the valve housing 510.

Located below the inlet portion 514, the valve housing 510 may include a second/distal portion 516 that has a larger inner diameter than that of the inlet portion 514. It is important to note that the larger inner diameter may expand gradually like that shown in FIGS. 12A to 12E or the increase in diameter may happen in a single step (e.g., the diameter does not gradually expand from the inner diameter of the inlet portion 514 to the inner diameter of the second/distal portion 516). As discussed in greater detail below, the increased diameter portion 516 helps the aperture 210 within the valve mechanism open during operation.

The valve member may be an elastomeric element 520 that include a proximal portion 522 (e.g., a septum) and a valve wall 524 that extends distally from the proximal portion 522 within the inlet housing 510. The valve wall 524 forms a valve interior 526, and the valve member 520 also has a distal end 521 that preferably is open (e.g., to allow fluid flow though the valve member 520 and into the plasma container 100). To help support the valve member 520 within the inlet housing 510 and skirt 190, the valve member 520 may include a flange 527 that extends radially outward from the distal portion 521 of the valve member 520 and contacts a shelf portion 192 of the skirt 190. Like the embodiments described above, the valve member/elastomeric element 520 may be secured within the top 120 via a swage connection (or similar connection). To further support the valve member/elastomeric member 520 within the inlet housing 510 and help position the proximal portion 522 at the inlet 170, the valve member/elastomeric member 520 have a shoulder 523 that contacts an inner surface of the inlet housing 510 (e.g., the angled/gradually expending diameter of the second/distal portion 516) when the valve mechanism is in the closed mode (e.g., when the cannula 240 is not connected).

During operation (e.g., during connection of the cannula 240), the user may insert the cannula 240, which may also have a luer taper on the outlet portion 242, into the inlet 170. As the cannula 240 is inserted, the valve member 520, which normally closes/seals the inlet 170, moves/deforms distally within the inlet housing 510. As the valve member 520 continues to move/deform distally into the inlet housing 510, the aperture 210 will open (e.g., when the proximal portion 522 enters the larger inner diameter portion of the inlet housing 510) to create fluid communication between the cannula 240 and the valve interior 526 (and interior of the plasma container 110). Conversely, when the cannula 240 is withdrawn from the inlet 170 (e.g., after collection is complete), the elastomeric properties of the valve member 520 cause the valve member 520 to begin to move proximally within the inlet housing 510 and return to its at-rest position with the inlet portion 514. This, in turn, causes the aperture 210 to close.

Figure 12A:
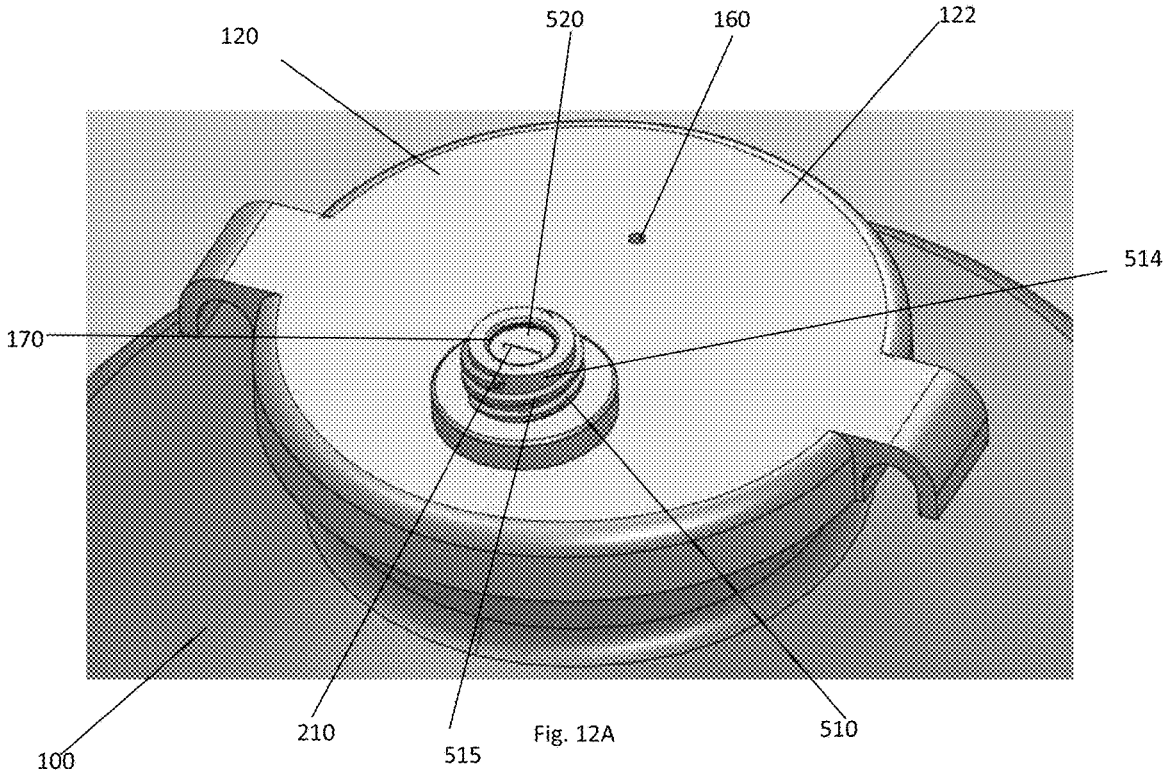
FIGS. 12A to 12E schematically show an additional alternative top for the plasma storage container, in accordance with further embodiments of the present invention.
Figure 12B:
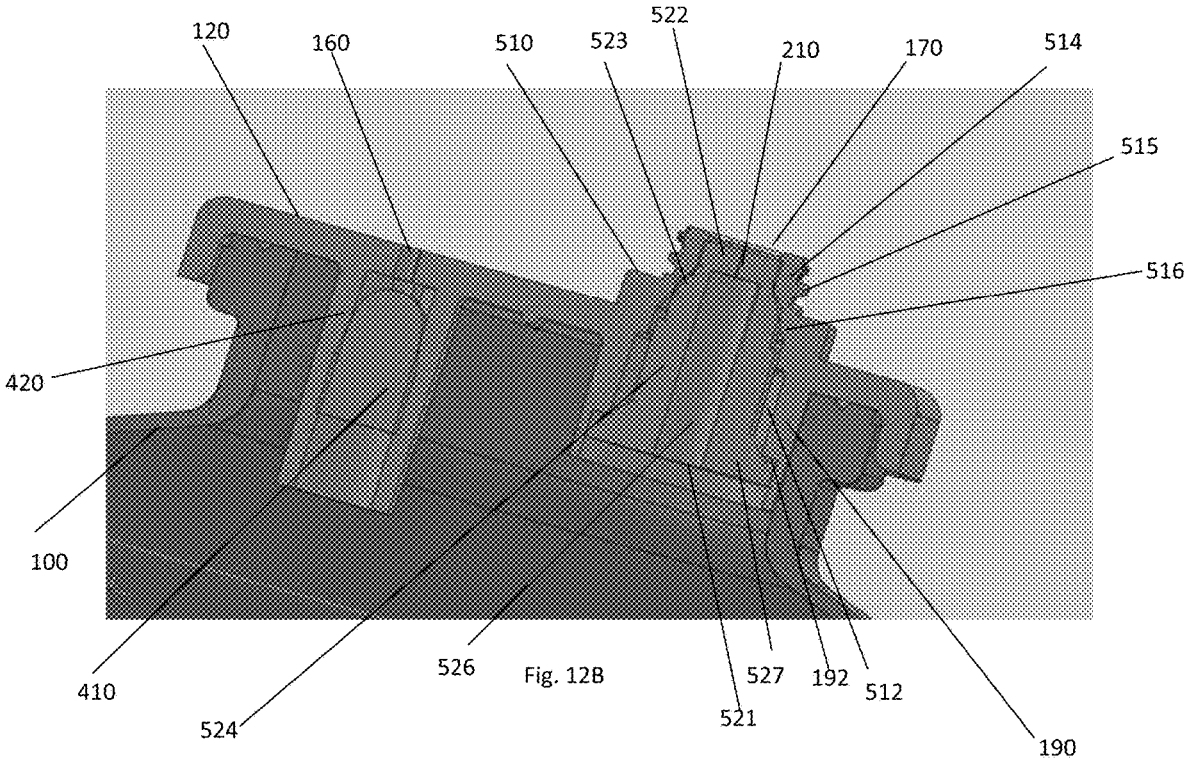
Figure 12C:
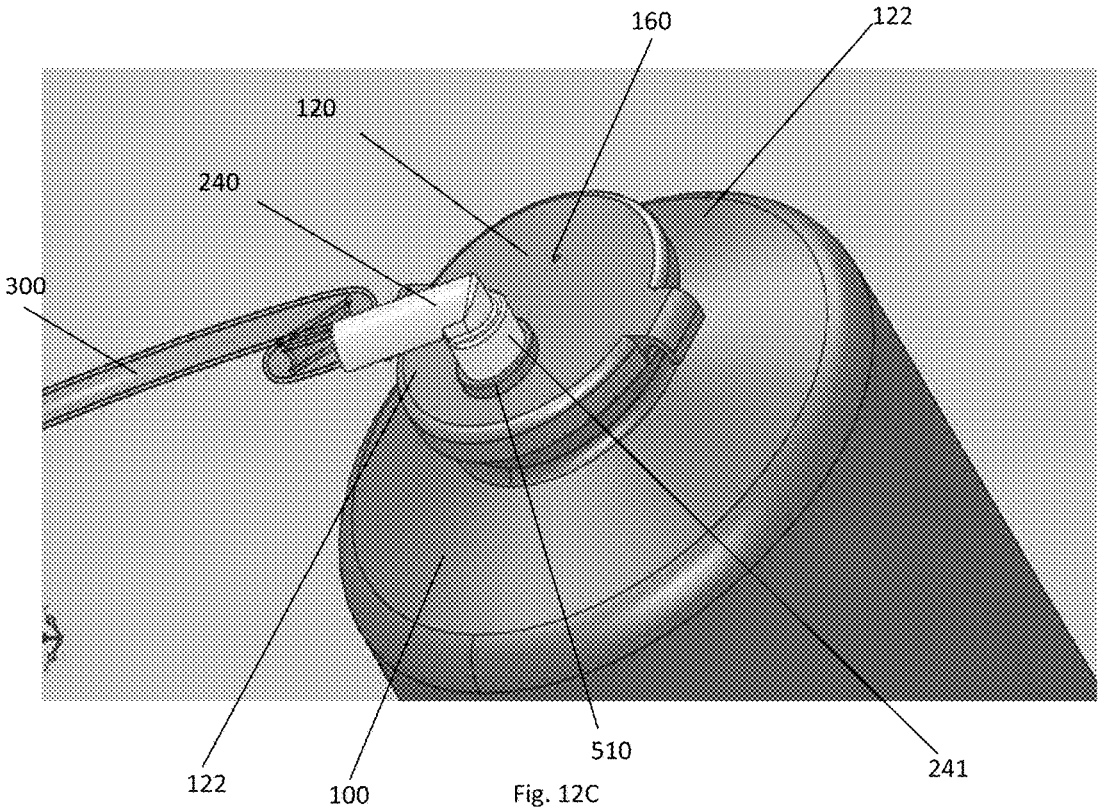
Figure 12D:
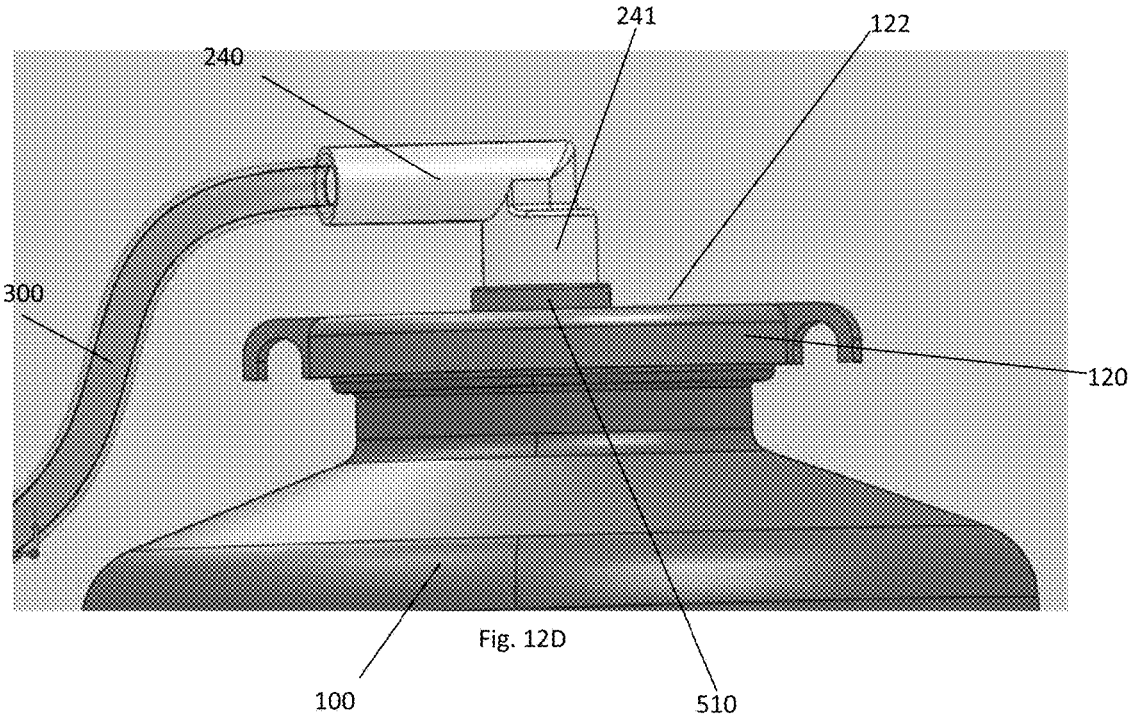
Figure 12E:
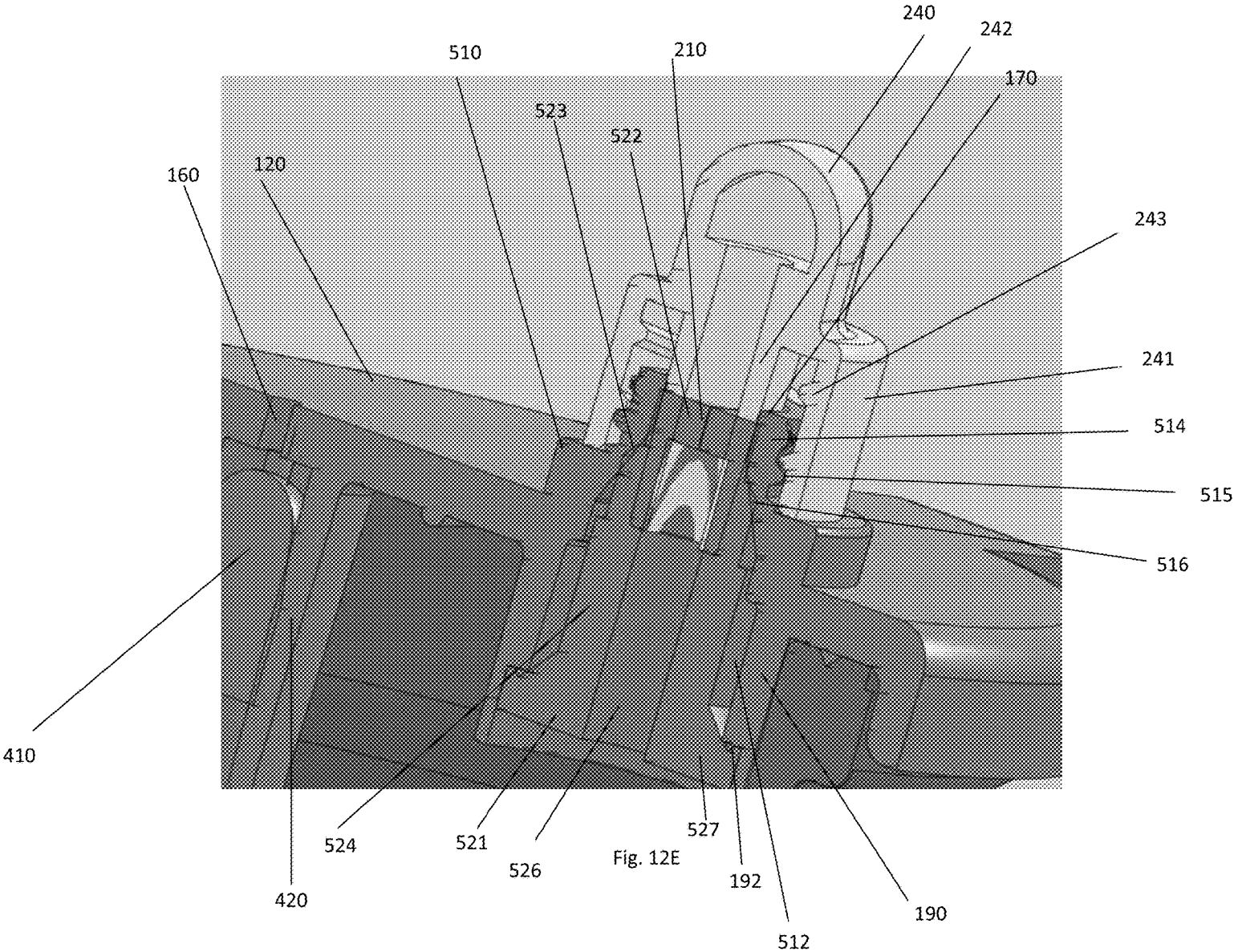

It should be noted that, in some embodiments, the cannula 240 (e.g., the outlet portion 242 of the cannula 240) does not enter (or only partially enters) the aperture 210. Rather, as shown in FIG. 12E, the outlet portion 242 of the cannula 240 may be sized such that it is relatively large as compared to the size of the aperture 210. In such embodiments, the outlet portion 242 of the cannula 240 will merely contact the top surface of the proximal portion 522 of the valve member and will not enter the aperture 210.

As noted above, some embodiments may have a retainer/clip 180 that secures the cannula 240 to the plasma container 100 and keeps the cannula 240 from accidentally disconnecting from the inlet 170 during use. Additionally or alternatively, as shown in FIGS. 12A-E, the outside surface of the inlet housing 510 may also have inlet threads 515 (e.g., luer lock threads) for connecting the cannula 240 and locking the cannula 240 in place. To that end, the cannula 240 may include a skirt 241 with internal threads 243 (e.g., on an internal surface of the skirt 241) (FIG. 12E) that engage with the threads 515 on the inlet housing 510. The inlet threads 510 and the threads 243 within the cannula skirt 241 may comply with ANSI/ISO standards (e.g., they are able to receive/connect to medical instruments complying with ANSI/ISO standards).

It is important to note that although luer lock threads are discussed above, other embodiments may use other connections such as a BNC connection. For example some embodiments, may utilize connections that lock with only a partial turn. Such connections may include radial protrusions (on the inlet housing 510 or the cannula 240) that mate with a ramped surface (e.g., on the inlet housing 510 or cannula).

Figure 13A:
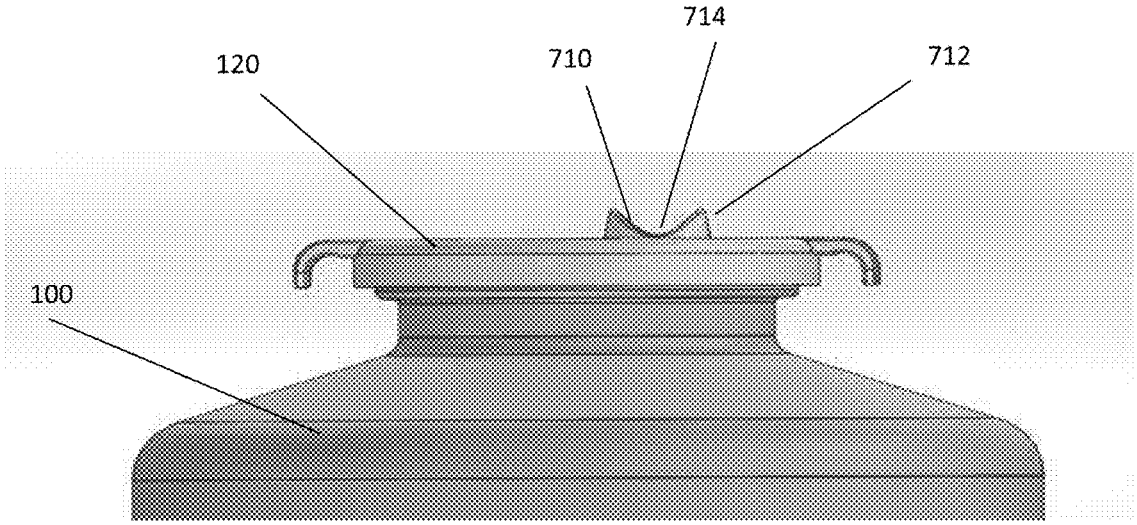
FIGS. 13A to 13C schematically show a further alternative top for the plasma storage container, in accordance with further embodiments of the present invention.
Figure 13B:
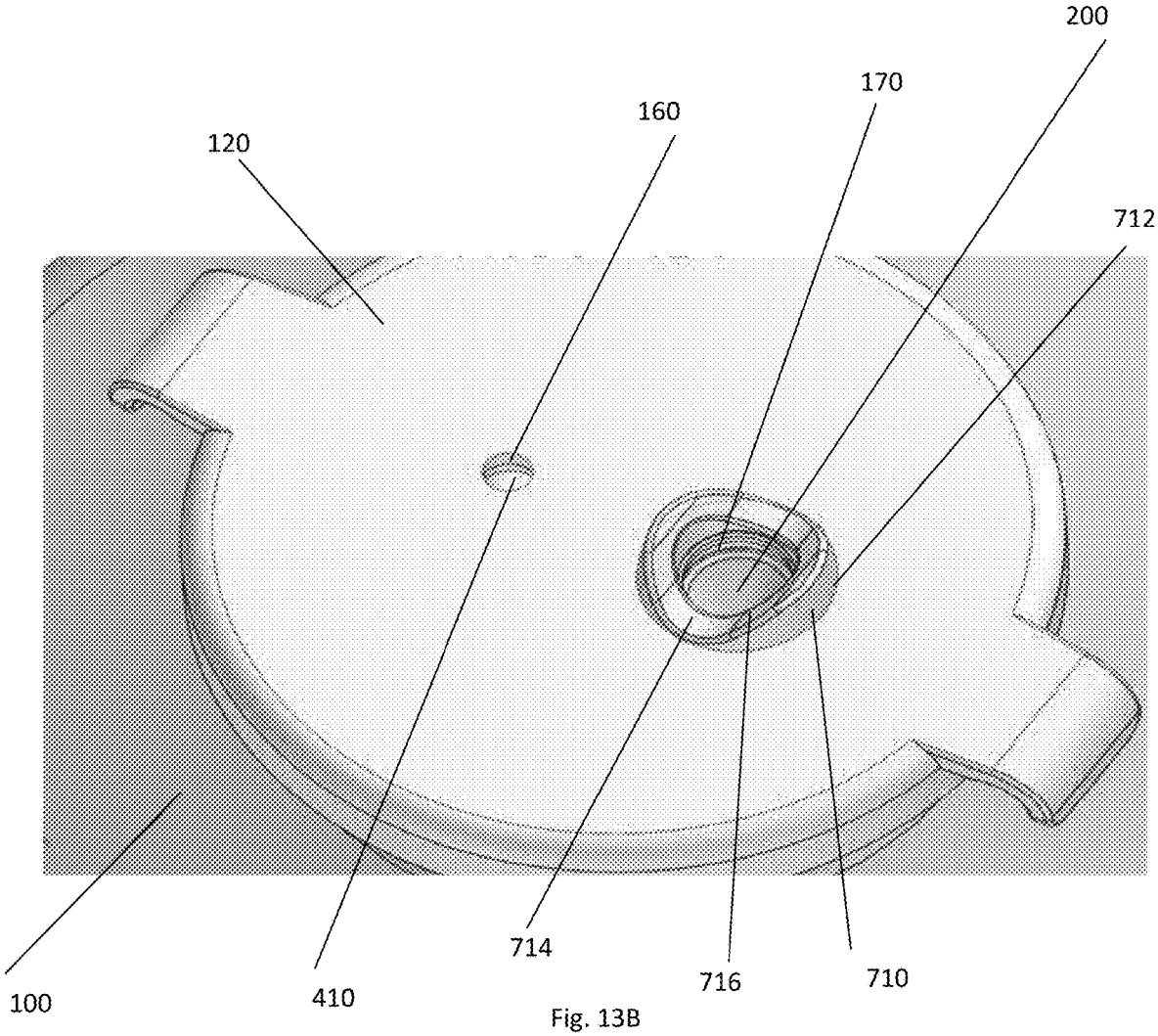
Figure 13C:
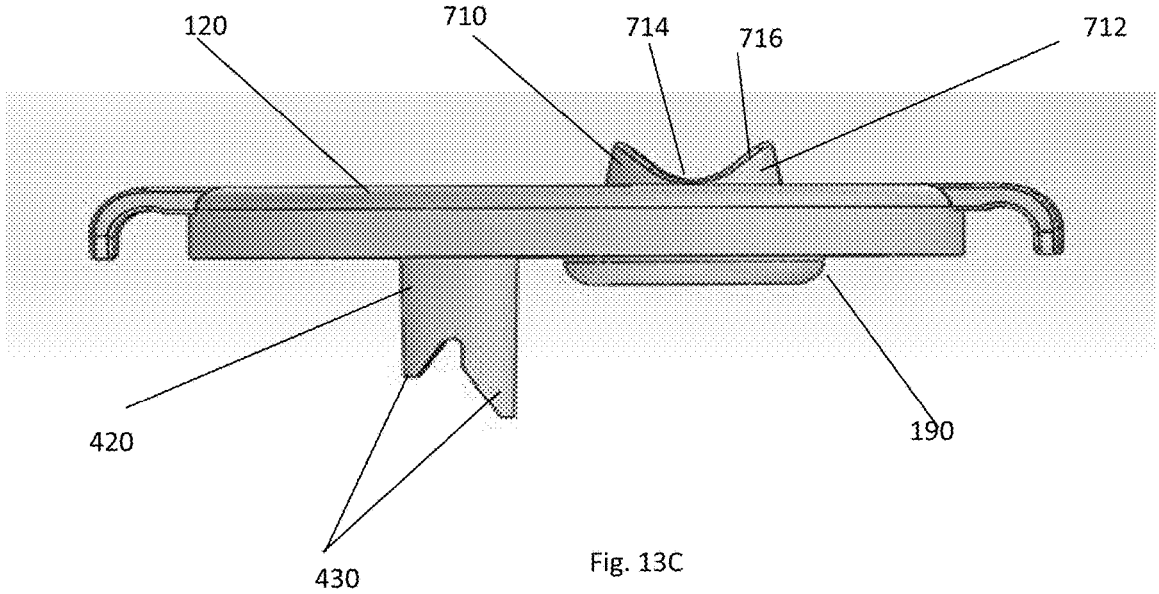
Figure 14:
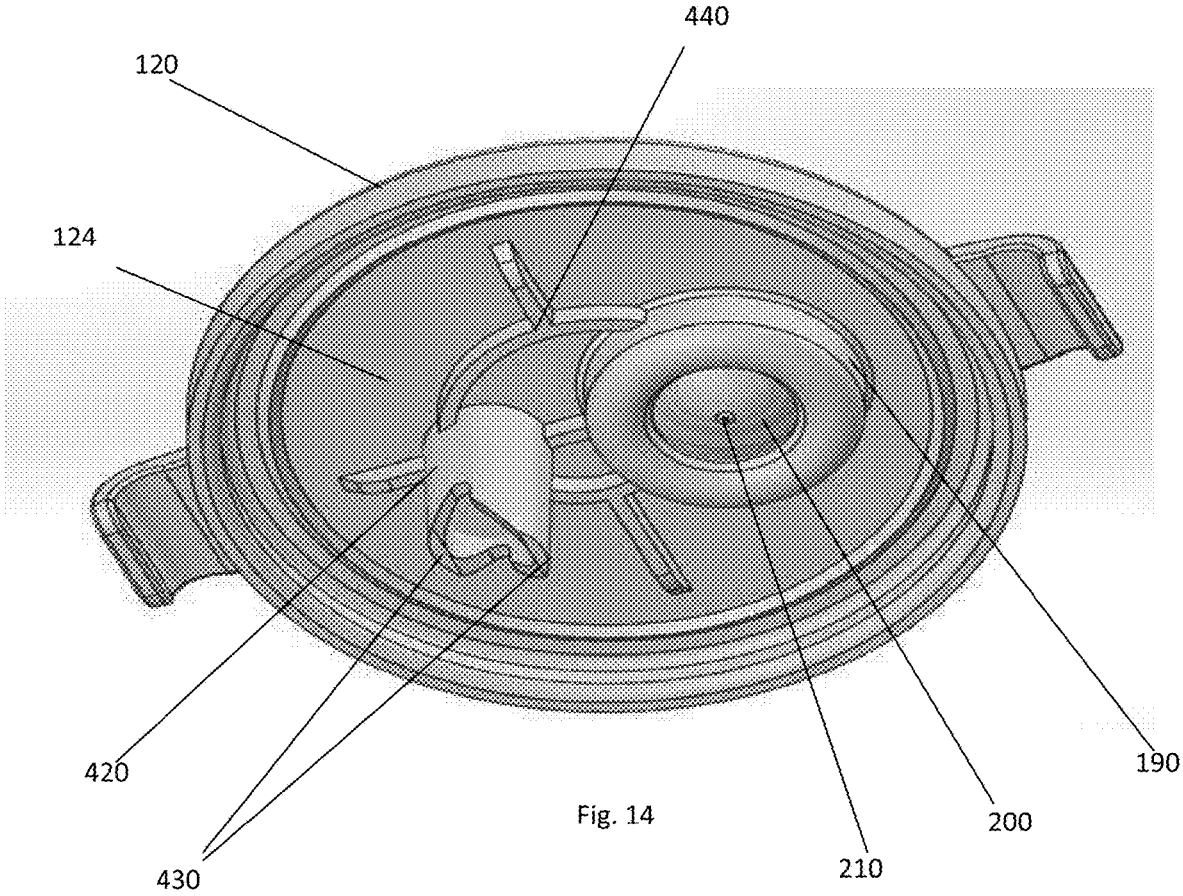
FIG. 14 schematically shows the bottom of the alternative top shown in FIGS. 13A-13C, in accordance with additional embodiments of the present invention.

FIGS. 13A-13C show a top for a plasma storage container with a different mechanism to connect the cannula 240 to the inlet 170 of the top 120. Like the top 120 described above and shown in FIGS. 4 and 5, the top shown in FIGS. 13A-13C may include a septum 200 (e.g., a valve mechanism) that is located and secured within a skirt 190 extending from the underside of the top 120. The septum 200 may be swaged within the skirt 190 and may have an aperture 210 (e.g., a normally closed aperture) that extends through it to allow the cannula 240 to access the interior of the container 100 upon connection. As discussed above, the aperture 210 may be one or more slits that extend through the septum 200 or, as shown in FIG. 14, may be a pre-pierced hole that opens under elastic deformation when the cannula 240 is connected.

To help with the connection and disconnection of the cannula 240, the top 120 may have cannula support structure 710 that extends from the top surface 122 of the top 120 and around the inlet 170. The cannula support structure 710 may be cup/u-shaped such that the wall 712 of the structure 710 slopes downward to create a channel 714 within support structure 710. As discussed in greater detail below, the cannula 240 may reside within the channel 714 after connection to inlet 170 and the cannula support structure 710 (e.g., the top surface 716 of the structure) may act as a camming surface to help the user disconnect the cannula 240 from the top 120.

Figure 15:
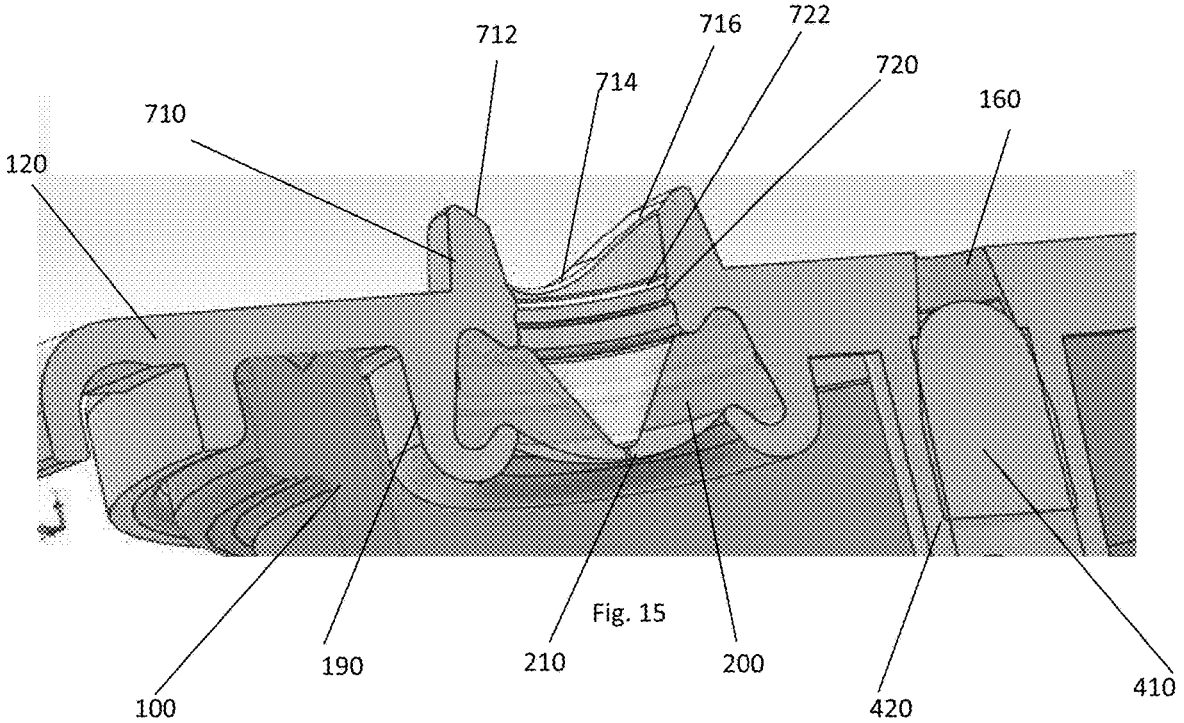
FIG. 15 schematically shows a cross-sectional view of the alternative top shown in FIGS. 13A-13C, in accordance with additional embodiments of the present invention.
Figure 16:
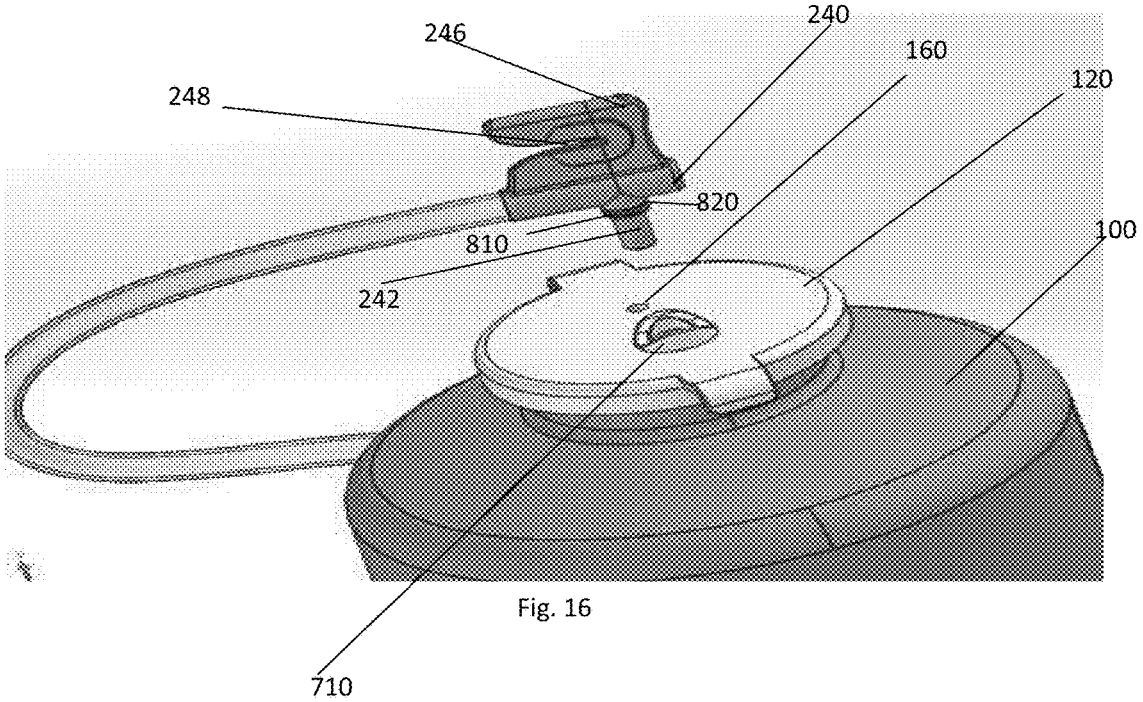
FIG. 16 schematically shows a plasma container with the top shown in FIGS. 13A-C and a cannula about to be inserted into the inlet, in accordance with some embodiments of the present invention.
Figure 17A:
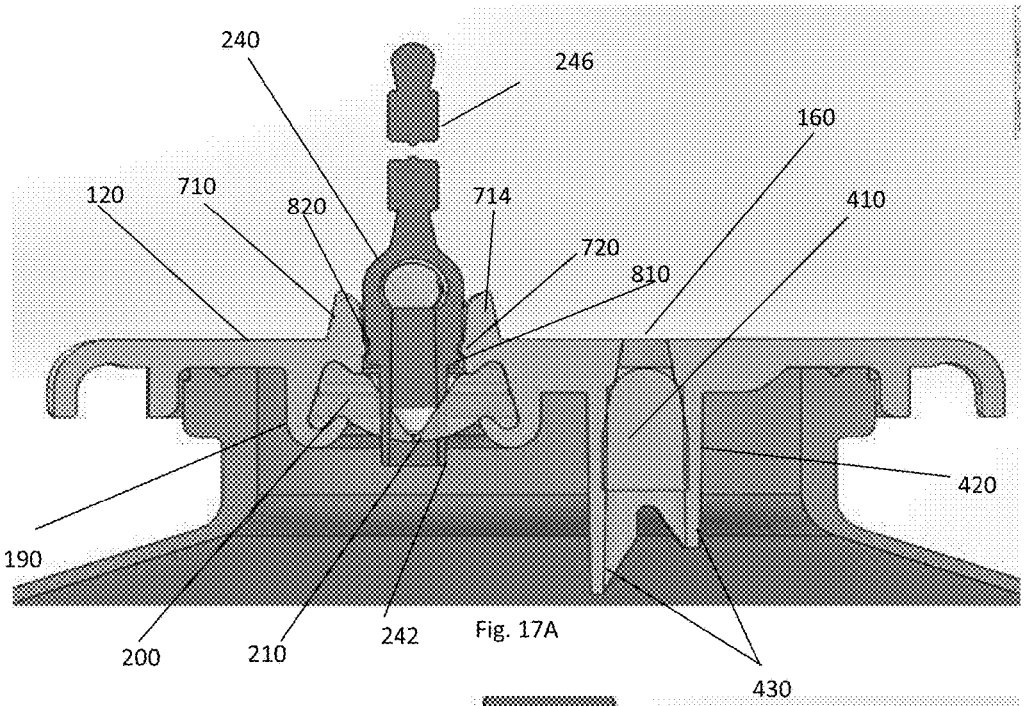
FIGS. 17A to 17B schematically show cross-sectional views of a cannula connected to the top shown in FIGS. 13A-C, in accordance with further embodiments of the present invention.
Figure 17B:
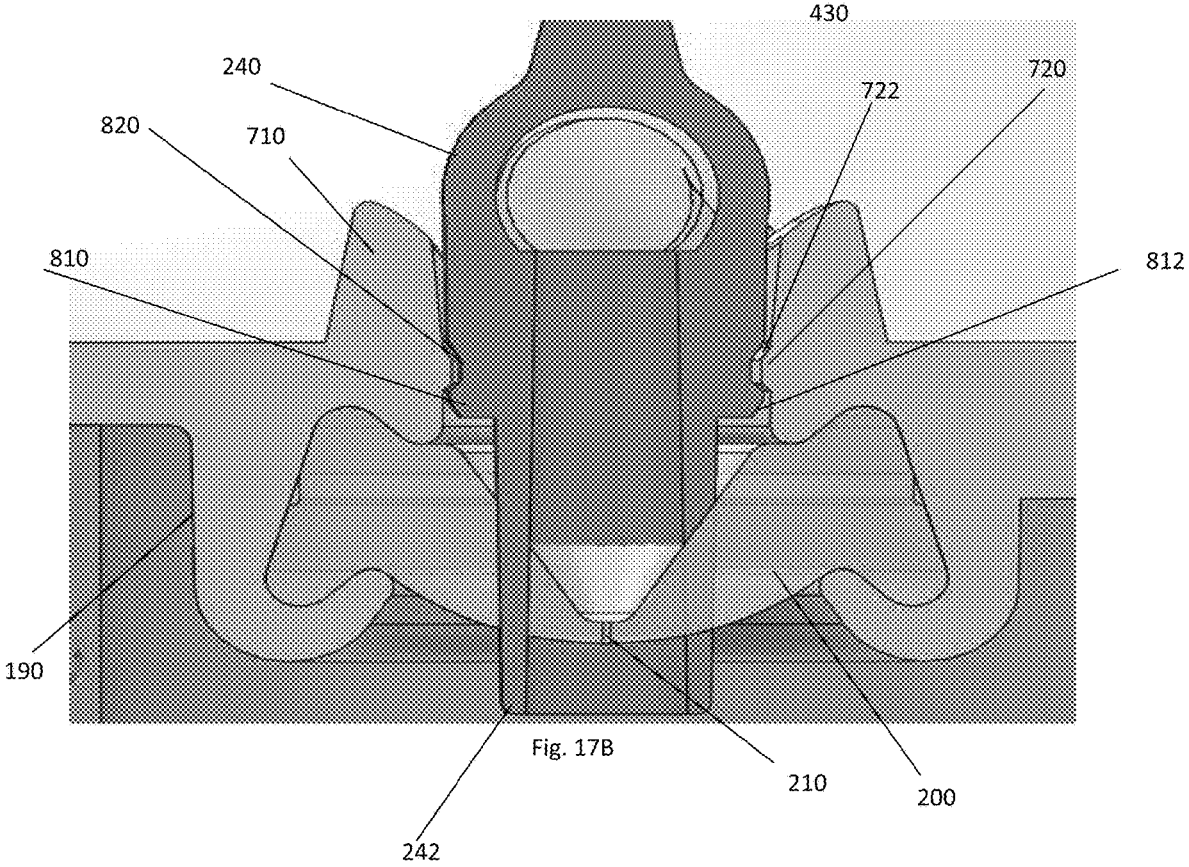
Figure 18:
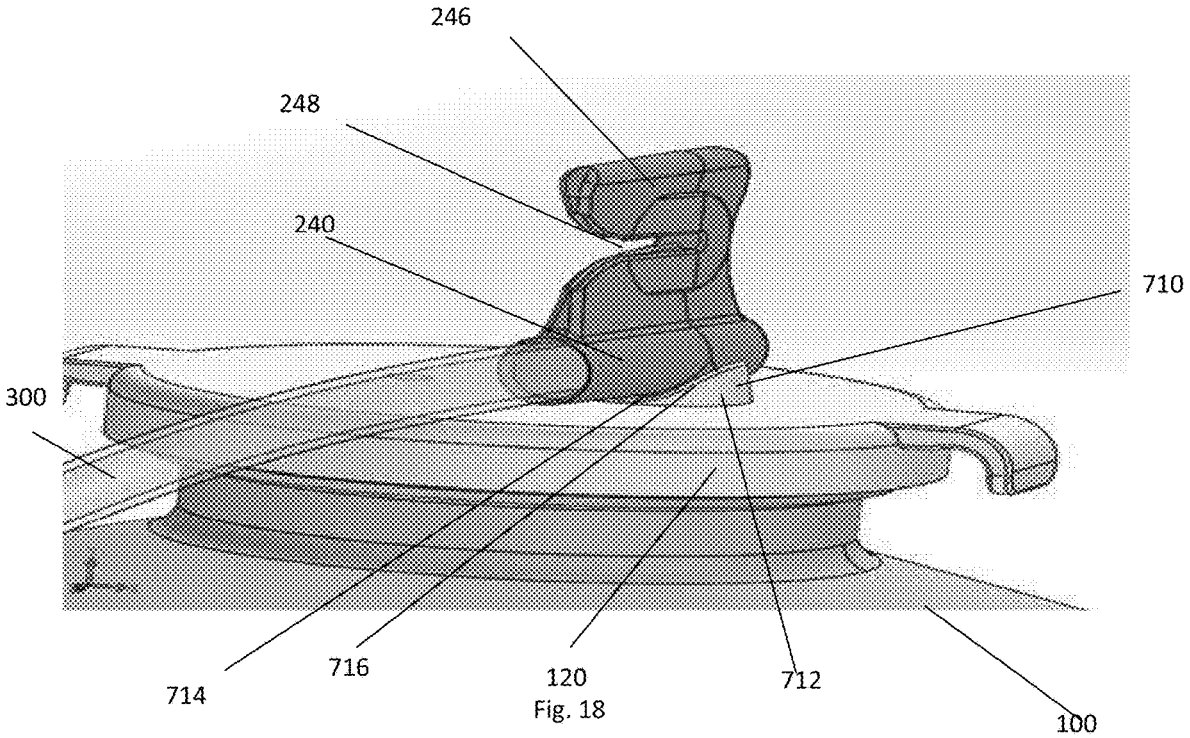
FIG. 18 schematically shows a cannula connected to the top shown in FIGS. 13A-C, in accordance with further embodiments of the present invention.

Within the interior of the inlet 170, the top 120 may have an inwardly projecting protrusion 720 (e.g., an inlet protrusion) that extends from the inner surface of the inlet 170 (FIG. 15). During connection of the cannula 240, the protrusion 720 may interact with a protrusion 810 on the cannula 240 (FIG. 16) to secure the cannula 240 in place. For example, as the user connects the cannula 240 (e.g., by inserting the cannula 240 into the inlet 170), the protrusion 810 on the cannula 240 will contact the inlet protrusion 720. As the user applies additional pressure, the cannula protrusion 810 will snap over the inlet protrusion 720 such that the inlet protrusion 720 resides within a recess 820 on the cannula 240 (FIG. 17A/17B). At this point, the cannula 240 is fully connected as shown in FIG. 18 and the aperture 210 within the septum 200 is open to allow fluid (e.g., plasma to be collected within the container 100). Additionally, because of the interaction between the cannula protrusion 810 and the inlet protrusion 720, the cannula 240 may not be inadvertently disconnected from container 100 (e.g., by accidental bumping, etc.).

Although FIGS. 15 and 17A/B show the inlet protrusion 720 as extending around the entire circumference of the inlet opening 170, in other embodiments, the protrusion 720 may only extend around a portion of the inlet opening 170. Additionally or alternatively, some embodiments may include more than one inlet protrusion 720 (e.g. two or more) that are spaced about the diameter of the inlet opening 170. Similarly the cannula protrusion 810 and recess 820 may not extend around the entire circumference of the cannula 240. In such embodiments, the protrusion 810 and recess 820 may only extend around a portion of the circumference and/or there may be more than one protrusion 810 and recess 820 that are spaced about the circumference of the cannula 240.

It should be noted that the cannula protrusion 810 and/or the inlet protrusion 720 may have features that reduce the force required to connect the cannula 240 and snap the inlet protrusion 720 over the cannula protrusion 810 and into the recess 820. For example, the surface 722 of the inlet protrusion 720 that contacts the cannula protrusion 810 and/or the surface 812 of the cannula protrusion 810 that contacts the inlet protrusion 720 may be angled to allow the protrusions to more easily pass over one another.

Figure 19:
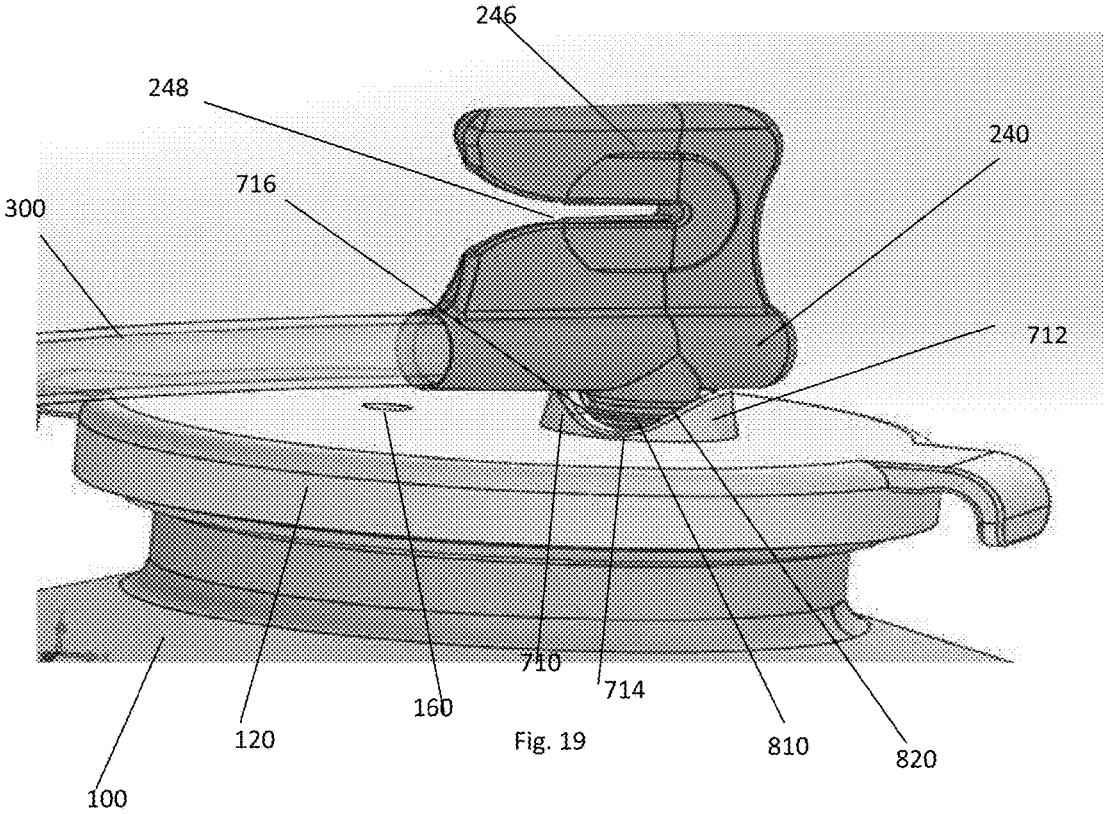
FIG. 19 schematically shows a cannula being disconnected from the top shown in FIGS. 13A-C, in accordance with additional embodiments of the present invention.

As noted above, the top surface 716 of the cannula support structure 710 may act as a camming surface that helps to disconnect the cannula 240 after fluid collection is complete. To that end, once the fluid collection is complete and the user wishes to disconnect the cannula 240, the user may grab the cannula 240 (e.g., via the body 240 and/or the grasping element 246) and turn the cannula 240 (e.g., clockwise or counter-clockwise) (FIG. 19). As the user turns the cannula 240, the cannula 240 will begin to slide up the top surface 716 of the support structure 710, causing the inlet protrusion 720 to snap over the cannula protrusion 810 to disconnect the cannula 240 from the inlet 170.

During processing the user/technician may need to occlude the various tubing/tubes within the collection system (e.g. the tube within the tubing set 300 or other tubing used during collection). To that end, some embodiments may incorporate an additional clamp within the set. For example, as shown in FIGS. 16, 18 and 19, the grasping element 246 may be formed with a tubing clamp 248. In use, if the technician wishes to occlude a section of tube, the technician may slide the tube into the tubing clamp 248 which will, in turn, deform and close the tube to prevent fluid from flowing through the tube.

Figure 20:
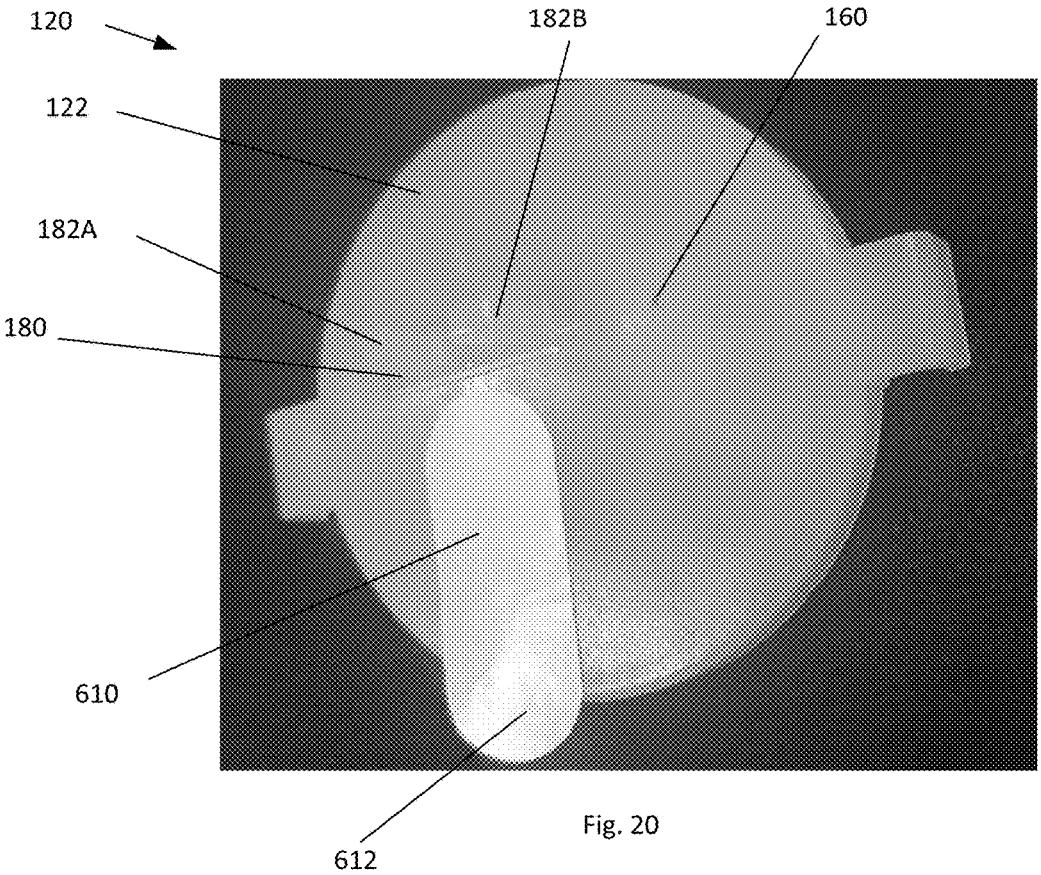
FIG. 20 schematically shows a sterile barrier located on a top, in accordance with some embodiments of the present invention.
Figure 21:
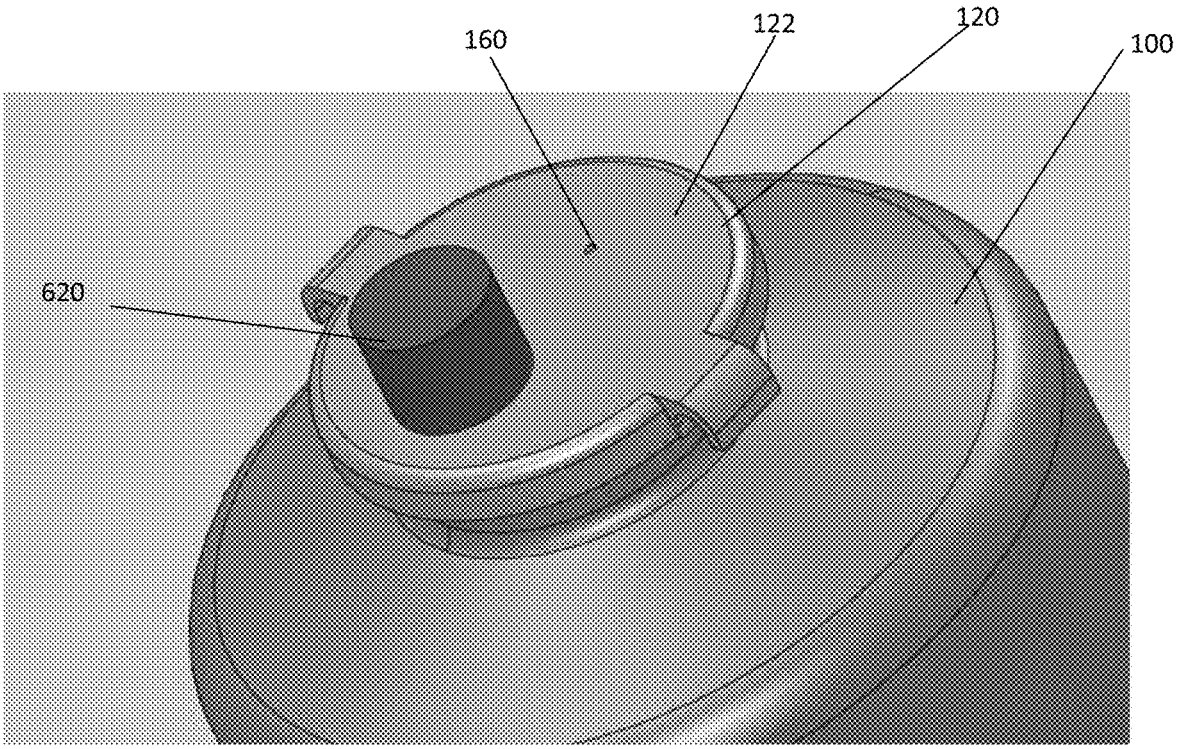
FIG. 21 schematically shows an alternative sterile barrier, in accordance with additional embodiments of the present invention.

It is important to note that, in some applications, it may be beneficial to keep the inlet 170 sealed and/or sterile prior to use and connection of the cannula 240. To that end, some embodiments may include a sterile barrier that may be placed over the inlet 170. For example, as shown in FIG. 20, the top 120 may include a sterile barrier 610 (e.g., a removable label) that may be secured to the top surface 122. The sterile barrier 610 may be secured to the top in any number of ways including, but not limited to, adhesive, welding, and bonding. To help with removal of the sterile barrier 610, the sterile barrier 610 may include a pull tab 612 that the user may grab and pull to peel the barrier 610 off of the inlet 170. In embodiments that include the valve housing 510, the top 120 may alternatively include a removable cap/cover 620 (FIG. 21) located over the valve housing 510 (e.g., over the inlet portion 514). Like the skirt 241 of the cannula 240, the inside of the cap/cover 620 may include threads (not shown) that screw onto the threads on the inlet portion 514.

Figure 22:
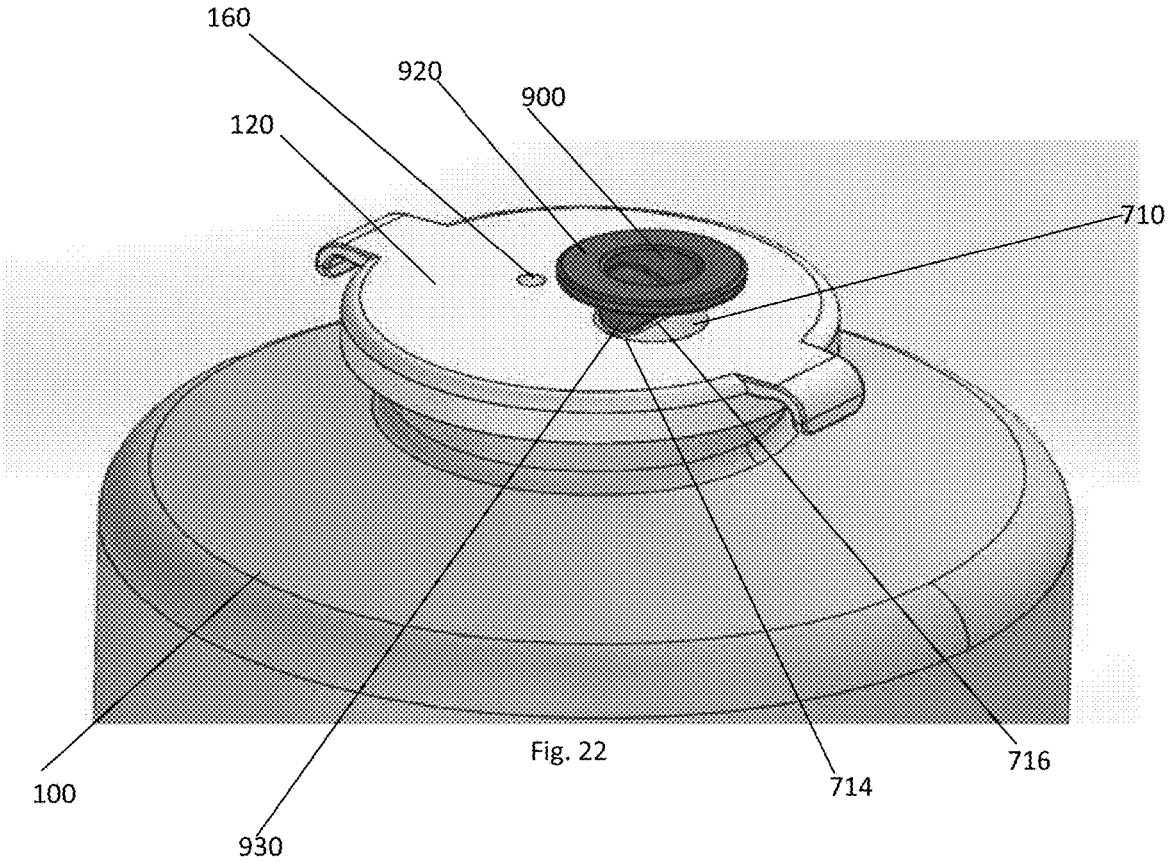
FIGS. 22 to 24 schematically show an additional alternative sterile barrier, in accordance with additional embodiments of the present invention.
Figure 23:
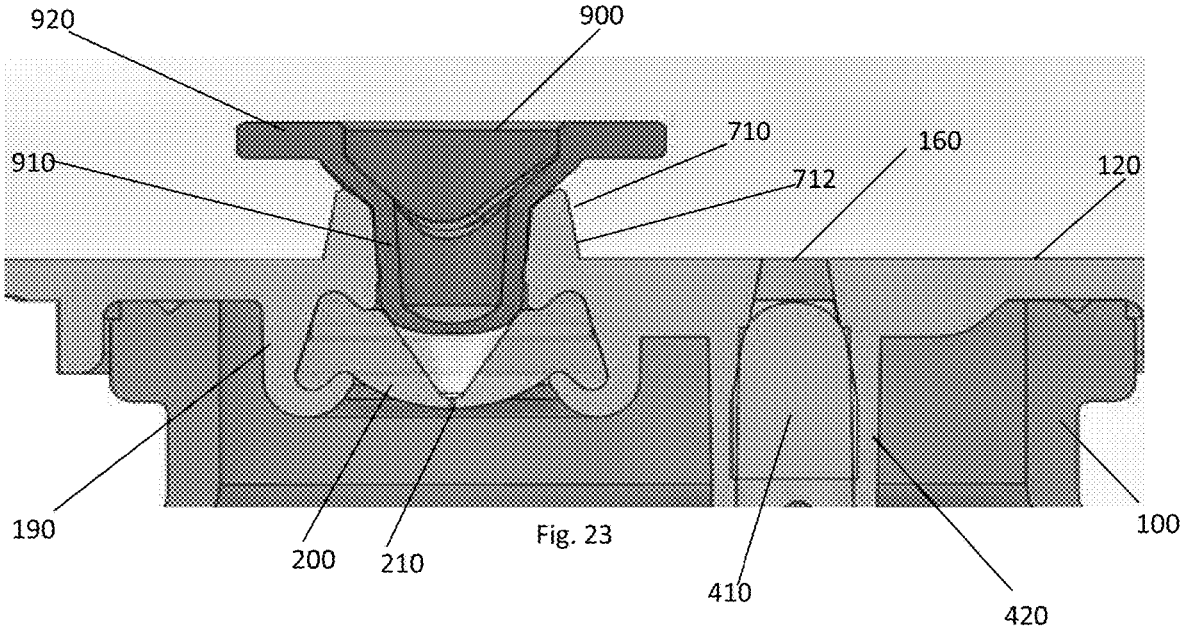
Figure 24:
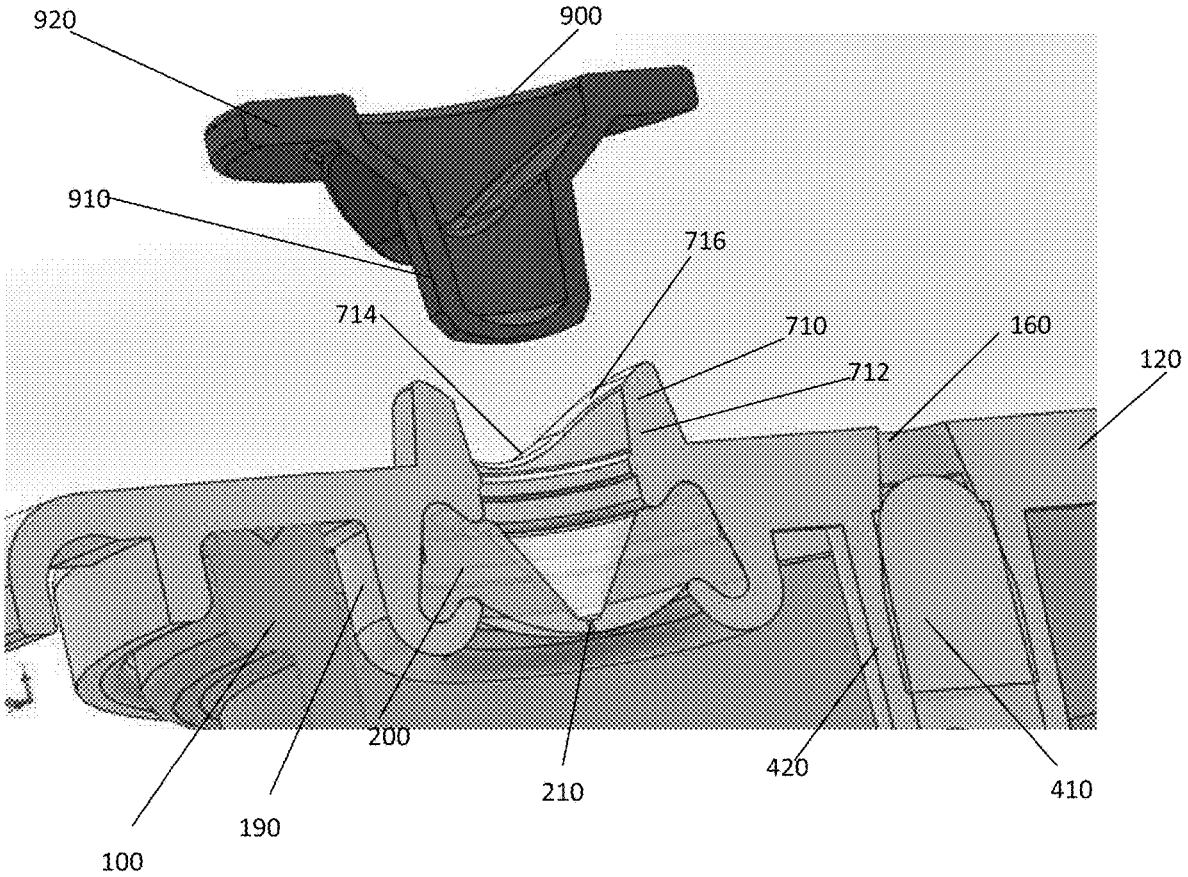

For embodiments like that shown in FIGS. 13A-13C, the cap 900 may have a lower portion 910 that extends into the inlet 170 when connected to the plasma container 100 to close the inlet and maintain the sterility (see FIGS. 22-24). The lower portion 910 that extends into the inlet 170 may have a protrusion that interacts with the inlet protrusion 720 in a manner similar to the cannula protrusion and/or the lower portion 910 may be sized such that it is press-fit into the inlet 170. On either side of the cap 900 (or both sides of the cap 900), the cap 900 may include a mating portion 930 that rests within/mates with the channel 714 within support structure 710. To remove the cap 900, in a manner similar to the cannula 240, the user may grab and turn the cap 900 to cause the mating portion 930 to slide up the top surface 716 (e.g., the camming surface) of the support structure 710, causing the cap 900 to disconnect from the inlet 170. Alternatively, the user may simply grab the cap 900 and pull the cap 900 out of the inlet 170. To make it easier for the user to grab the cap 900 during removal, the top of the cap 900 may have a flange 920 that extends from the cap 900.

Although the embodiments described above eliminate both the port for introducing plasma into prior art containers and the port for venting prior art containers (e.g., the ports extending from the plasma container and the sections of tubing connected to the ports, discussed above), some embodiments may eliminate only a single port (e.g., the container may retain one port). For example, some embodiments may utilize the inlet hole 170 and valve member/septum 200 but retain the vent port (e.g., a vent port extending from the plasma container and having a section of tubing connected to it). Alternatively, some embodiments may utilize the vent hole 160 and hydrophobic membrane 230 (or plug filter 410) but retain the port to introduce plasma into the bottle (e.g., an inlet port extending from the plasma container and having a section of tubing extending from it).

It should be noted that various embodiments of the present invention provide numerous advantages over prior art plasma storage containers. For example, because embodiments of the present invention eliminate one or more of the plastic stubs and ports mentioned above, some embodiments of the present invention are able to reduce and/or eliminate the risk of breaking and comprising product sterility. Furthermore, various embodiments of the present invention are able to eliminate the need for heat/RF sealing equipment and processes for sealing tubing prior to transportation and storage. Additionally, because embodiments of the present invention allow for sample collection directly via the septum 200 (e.g., as opposed to drawing plasma into a section of tubing first like in many prior art systems), the present invention is able to collect a highly representative sample of the plasma with little/no loss.

The embodiments of the invention described above are intended to be merely exemplary; numerous variations and modifications will be apparent to those skilled in the art. All such variations and modifications are intended to be within the scope of the present invention as defined in any appended claims.

What is claimed is:

1. A top for a plasma storage container comprising:

a top body defining the structure of the top and configured to seal an opening of the plasma storage container;

an inlet opening extending through the top body;

a valve mechanism located at least partially within the inlet opening, the valve mechanism including an aperture therethrough, the aperture configured to open upon connection of a cannula to the plasma storage container, thereby providing access to the interior of the plasma storage container;

a locking mechanism configured to lock the cannula to the top;

a vent opening extending through the top body; and a vent filter configured to allow air to vent through the vent opening during filling of the plasma storage container.

2. A top for a plasma storage container according to claim 1, wherein the valve mechanism includes a septum.

3. A top for a plasma storage container according to claim 2, further comprising:

a skirt extending from the underside of the top body around the first opening, the septum located and secured within the skirt.

4. A top for a plasma storage container according to claim 3, wherein the septum is secured within the skirt via swage connection.

5. A top for a plasma storage container according to claim 4, wherein the skirt and/or the swage connection applies a radially inward force on the septum, the radially inward force keeping the septum secured within the skirt.

6. A top for a plasma storage container according to claim 1, wherein the aperture is closed when the blunt cannula is not connected.

7. A top for a plasma storage container according to claim 1, wherein the aperture is configured to allow the cannula to at least partially enter the aperture after connection of the cannula to the plasma storage container.

8. A top for a plasma storage container according to claim 1, wherein the locking mechanism includes a locking protrusion extending from top body and into the inlet opening, the locking protrusion configured to snap into a recess within the cannula during connection of the cannula.

9. A top for a plasma storage container according to claim 8, wherein the cannula includes a cannula protrusion extending from a surface of the cannula, the locking protrusion configured to snap over the cannula protrusion and into the recess during connection of the cannula.

10. A top for a plasma storage container according to claim 9, wherein at least one surface of the locking protrusion is angled to allow the locking protrusion to snap over the cannula protrusion.

11. A top for a plasma storage container according to claim 1, further comprising:

a cannula support structure extending from a top surface of the top, the cannula support structure defining a channel configured to support the cannula when connected to the plasma storage container.

12. A top for a plasma storage container according to claim 11, wherein the cannula support structure includes a camming surface, rotation of the cannula causing the cannula to slide up the camming surface, thereby causing the locking protrusion to snap out of the recess and disconnecting the cannula from the plasma storage container.

13. A top for a plasma storage container according to claim 1, further comprising a cap configured to be connected to the inlet opening, the cap providing a sterile barrier for the inlet opening prior to the connection of the cannula.

14. A top for a plasma storage container according to claim 13, wherein the cap includes a lower portion that extends into the inlet opening when connected to the plasma storage container.

15. A top for a plasma storage container according to claim 13, wherein the cap includes a mating portion configured to mate with at least a portion of a channel of a cannula support structure.

16. A top for a plasma storage container according to claim 1, wherein the cannula includes a grasping element configured to allow a user to grasp the cannula during use.

17. A top for a plasma storage container according to claim 1, wherein the grasping element includes a clamp.

18. A top for a plasma storage container according to claim 1, wherein the cannula is part of a tubing set connected to a blood processing device.

19. A top for a plasma storage container according to claim 18, wherein the tubing set includes a connector configured to connect to a blood component separation device and a cap secured to the connector via a tether.

20. A top for a plasma storage container according to claim 19, wherein the cannula is secured to the tether prior to use.

21. A top for a plasma storage container according to claim 1, wherein the inlet opening is larger than the vent opening.

22. A top for a plasma storage container according to claim 1, wherein the vent filter includes a hydrophobic membrane located on an underside of the top body and covering the vent opening.

23. A top for a plasma storage container according to claim 22, wherein the top body includes at least one flow channel on an underside of the top body, the at least one flow channel in fluid communication with the vent opening to allow airflow in and out of the plasma storage container via the vent opening.

24. A top for a plasma storage container according to claim 22, wherein a surface area of the hydrophobic membrane is larger than a cross-sectional area of the vent opening.

25. A top for a plasma storage container according to claim 22, wherein the hydrophobic membrane is sealed to the underside of the top body.

26. A top for a plasma storage container according to claim 1, wherein the vent filter includes a plug filter.

27. A top for a plasma storage container according to claim 26, wherein the plug filter is a self-sealing filter configured to seal the vent opening upon exposure of the plug filter to liquid.

28. A top for a plasma storage container according to claim 26, further comprising:

a vent skirt extending from the top body around the vent opening, the plug filter located and secured within the vent skirt.

29. A top for a plasma storage container according to claim 28, wherein the vent skirt extends from the underside of the top body.

30. A top for a plasma storage container according to claim 29, further comprising at least one splash guard extending from the vent skirt, the splash guard configured to prevent liquid from contacting the plug filter during filling of the plasma storage container.

31. A top for a plasma storage container according to claim 1, wherein the locking mechanism includes a retainer located on a top surface of the top body, the retainer configured to hold the blunt cannula in place during filling of the plasma storage container.

32. A top for a plasma storage container according to claim 31, wherein the retainer is a clip.

33. A top for a plasma storage container according to claim 1, wherein the valve mechanism is further configured to allow a sample collection container holder to pass through the aperture to access the interior of the plasma collection container.

34. A top for a plasma storage container according to claim 33, wherein the sample collection container holder is a vacutainer holder.

35. A top for a plasma storage container according to claim 1, further comprising at least one stiffening rib located on an underside of the top.

36. A top for a plasma storage container according to claim 1, wherein the valve mechanism includes a resilient member, the resilient member having a septum located nearer the top of the resilient member and a valve wall that extends downward from the septum.

37. A top for a plasma storage container according to claim 36, wherein the aperture extends through the septum.

38. A top for a plasma storage container according to claim 36, wherein the valve wall forms a valve interior.

39. A top for a plasma storage container according to claim 36, further comprising a valve housing extending from a top surface of the top, the valve mechanism at least partially located within valve housing.

40. A top for a plasma storage container according to claim 39, wherein the valve housing includes an inlet portion, the septum located at least partially within the inlet portion.

41. A top for a plasma storage container according to claim 40, wherein an inner surface of the inlet portion includes a luer taper.

42. A top for a plasma storage container according to claim 39, wherein the valve housing further includes a second portion located below the inlet portion, the second portion having an inner diameter that is greater than an inner diameter of the inlet portion.

43. A top for a plasma storage container according to claim 39, wherein the valve housing further includes a second portion located below the inlet portion, the second portion having an inner diameter that expands along a length of the second portion.

44. A top for a plasma storage container according to claim 43, wherein connection of the blunt cannula to the plasma storage container causes the septum to move from the inlet portion of the valve housing to the second portion, thereby allowing the aperture to open.

45. A top for a plasma storage container according to claim 39, wherein the valve housing includes the locking mechanism.

46. A top for a plasma storage container according to claim 45, wherein the locking mechanism includes luer threads, the blunt cannula having a skirt and threads within the skirt, the threads configured to engage the luer threads on the valve housing.

47. A plasma storage container comprising:

a container body defining the structure of the plasma storage container and defining an interior;

a container top having a top body and configured to seal an opening of the plasma storage container;

an inlet opening extending through the top body;

a valve mechanism located at least partially within the inlet opening, the valve mechanism including an aperture therethrough, the aperture configured to open upon connection of a cannula to the plasma storage container, thereby providing access to the interior of the plasma storage container;

a locking mechanism configured to lock the cannula to the top;

a vent opening extending through the top body; and a vent filter configured to allow air to vent through the vent opening during filling of the plasma storage container.

48. A plasma storage container according to claim 47, wherein the vent filter is further configured to prevent egress of liquid contents of the filled plasma storage container.

* * * * *